US010604285B2

(12) United States Patent
Shindou

(10) Patent No.: US 10,604,285 B2
(45) Date of Patent: Mar. 31, 2020

(54) REINFORCING BAR BINDING MACHINE

(71) Applicant: MAX CO., LTD., Tokyo (JP)

(72) Inventor: Shigeki Shindou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 1167 days.

(21) Appl. No.: 14/810,519

(22) Filed: Jul. 28, 2015

(65) Prior Publication Data

US 2016/0031575 A1 Feb. 4, 2016

(30) Foreign Application Priority Data

Jul. 31, 2014 (JP) ..... 2014-157199
Apr. 30, 2015 (JP) ..... 2015-093664

(51) Int. Cl.

| | |
|---|---|
| ***B65B 13/00*** | (2006.01) |
| ***B65B 13/02*** | (2006.01) |
| ***B65B 13/06*** | (2006.01) |
| ***B65B 13/28*** | (2006.01) |
| ***E04G 21/12*** | (2006.01) |

(52) U.S. Cl.

CPC ..... *B65B 13/025* (2013.01); *B65B 13/06* (2013.01); *B65B 13/285* (2013.01); *E04G 21/123* (2013.01)

(58) Field of Classification Search

CPC ..... B65B 13/025; B65B 13/16; B65B 13/04; B65B 13/06; E04G 21/123

See application file for complete search history.

(56) References Cited

U.S. PATENT DOCUMENTS

| | | | |
|---|---|---|---|
| 4,362,192 | A | 12/1982 | Furlong et al. |
| 4,508,030 | A | 4/1985 | Grenon |
| 5,558,134 | A | 9/1996 | Miyazaki |
| 5,743,309 | A | 4/1998 | Slater Christensen |
| 5,871,036 | A | 2/1999 | Murayama et al. |

(Continued)

FOREIGN PATENT DOCUMENTS

| | | | |
|---|---|---|---|
| CN | 101586399 | A | 11/2009 |
| CN | 102322150 | A | 1/2012 |

(Continued)

OTHER PUBLICATIONS

Machine Translation of CN 102441625 (May 9, 2012) (Year: 2012).*

(Continued)

*Primary Examiner* — Debra M Sullivan

(74) *Attorney, Agent, or Firm* — Rothwell, Figg, Ernst & Manbeck, P.C.

(57) ABSTRACT

A reinforcing bar bending machine detachably mounts a wire reel thereto, feeds a wire from the mounted wire reel to a guide part provided at a tip portion of a binding machine main body, curls the wire at the guide part, feeds the wire around reinforcing bars to wind around reinforcing bars, cuts the wire with a wire cutting mechanism, and twists the wound wire to bind the reinforcing bars. The wire cutting mechanism is a cutter including a moveable blade configured to slide or swing to a fixed blade or to rotate inside the fixed blade and to cut the wire. The guide part is provided with a holding device to hold a cut end portion-side of the wire cut and separated in conjunction with a cutting operation of the moveable blade. The holding device bends and holds the cut end portion-side of the cut and separated wire.

11 Claims, 16 Drawing Sheets

(56) References Cited

U.S. PATENT DOCUMENTS

| | | | |
|---|---|---|---|
| 2009/0283168 | A1 | 11/2009 | Kusakari |
| 2009/0283171 | A1 | 11/2009 | Nagaoka et al. |
| 2009/0283172 | A1 | 11/2009 | Itagaki |
| 2010/0147411 | A1 | 6/2010 | Kusakari et al. |
| 2010/0293902 | A1 | 11/2010 | Jensen |
| 2014/0246114 | A1 | 9/2014 | Kusakari et al. |
| 2014/0246115 | A1 | 9/2014 | Itagaki |
| 2015/0048194 | A1 | 2/2015 | Itagaki |
| 2015/0232212 | A1 | 8/2015 | Itagaki |
| 2015/0267423 | A1 | 9/2015 | Kusakari et al. |
| 2016/0031576 | A1 | 2/2016 | Shindou |
| 2016/0186451 | A1 | 6/2016 | Itagaki |
| 2016/0222683 | A1 | 8/2016 | Kusakari et al. |
| 2016/0297555 | A1 | 10/2016 | Itagaki |
| 2017/0305584 | A1 | 10/2017 | Itagaki |

FOREIGN PATENT DOCUMENTS

| | | | |
|---|---|---|---|
| CN | 102441625 | A | 5/2012 |
| CN | 102556393 | A | 7/2012 |
| CN | 203638143 | U | 6/2014 |
| EP | 2 196 600 | A2 | 6/2010 |
| JP | T-S58-500248 | | 2/1983 |
| JP | A-H09-165917 | | 6/1997 |
| JP | 2552384 | Y2 | 10/1997 |
| JP | 2010-1070 | A | 1/2010 |
| JP | 5309947 | B2 | 10/2013 |
| JP | 2016-33320 | A | 3/2016 |
| WO | WO-2007141822 | A1 | 12/2007 |

OTHER PUBLICATIONS

Notification of First Office Action dated Jul. 23, 2018 in corresponding Chinese Patent Application No. 201510463076.2 (with an English translation) (29 pages).

Extended European Search Report dated Mar. 1, 2016 from corresponding European Application No. 15002270.5 (8 pages).

* cited by examiner

REINFORCING BAR BINDING MACHINE

CROSS-REFERENCE TO RELATED APPLICATIONS

This application is based on and claims priority under 35 USC119 from Japanese Patent Application Nos. 2014-157199 filed on Jul. 31, 2014, and 2015-093664 filed on Apr. 30, 2015.

TECHNICAL FIELD

The present invention relates to a reinforcing bar binding machine configured to detachably mount a wire reel thereto, to feed out a wire pulled out from the mounted wire reel around reinforcing bars from a guide part provided at a tip portion of a binding machine main body so that the wire is wound around the reinforcing bars into a loop shape, and to twist the wire to thus bind the reinforcing bars.

BACKGROUND

A reinforcing bar binding machine is configured to insert two intersecting reinforcing bars in a curved guide part provided at a tip portion of a binding machine main body, to feed a wire from a wire reel mounted to the binding machine main body by a wire feeding device, to curl and feed out the wire at the guide part, and to wind the wire around the two reinforcing bars into a loop shape. Also, the reinforcing bar binding machine is configured to cut (shear) an end side of the wire by a wire cutting mechanism after winding the wire around the two reinforcing bars, to pick up and rotate one end of the wire loop by a pair of twisting hooks of a wire twisting device to thus twist the wire, and to tightly bind the reinforcing bars (refer to Patent Documents 1 and 2).

For the wire cutting mechanism, a slide cutter and a rotary cutter are mainly used. The slide cutter has a fixed blade having a wire penetration hole formed towards a wire feeding direction, and a movable blade configured to sliding-contact the fixed blade and to cut the wire, and includes a sliding type and a swinging type of the movable blade. The rotary cutter includes two types, i.e., an inner moveable blade type and an outer moveable blade type. The inner moveable blade type has a moveable blade having a wire penetration hole formed in a wire feeding direction and a fixed blade configured to rotatably accommodate the moveable blade, and is configured so that when the moveable blade is rotated, a wire entry opening-side of the wire penetration hole slides to the fixed blade and cuts (shears) the wire. The outer moveable blade type has a fixed blade having a wire penetration hole formed in the wire feeding direction and a moveable blade provided to be rotatable around the fixed blade, and is configured so that when the moveable blade is rotated, the moveable blade slides to a wire exit opening-side of the wire penetration hole of the fixed blade and cuts (shears) the wire.

[Patent Document 1] JP-Y-2552384

[Patent Document 2] JP-B-5309947

SUMMARY

When binding the reinforcing bars, the reinforcing bar binding machine performs operations of inserting the two intersecting reinforcing bars into the guide part provided at the tip portion of the binding machine main body, winding the wire around the two reinforcing bars to form a wire loop, cutting an end side of the wire, picking up and rotating one end of the wire loop by the pair of twisting hooks of the wire twisting device to twist the wire and to tightly bind the reinforcing bars, and detaching the guide part from the two reinforcing bars in the guide part after the wire binding. Since the wire is wound and twisted two times or three times around the reinforcing bars, the wire of the loop shape appropriate to the binding of the reinforcing bar binding machine should be preferably maintained even after the cutting. However, since the wire is cut immediately after the winding, both ends of the wire loop become at a free state and the loop shape is released, so that the appropriate loop shape may not be maintained. The wire is curled by the guide part, so that the wire loop is formed. However, the wire is metallic and thus has a restoring force. Therefore, when an end portion is cut and the both ends become at a free state, the restoring force acts in a direction of increasing a curl diameter (in an outer diameter direction), so that an outer diameter of the curl diameter increases, only the curl part wound last is unwound, and the like. Thereby, the appropriate loop shape may not be maintained. When the reinforcing bar binding machine cannot maintain the appropriate wire loop, as described above, a binding defect may be caused.

A number of rotations of the pair of twisting hooks set in the reinforcing bar binding machine is set in conformity to the appropriate curl diameter. Therefore, the number of twisting times is insufficient for the cut wire loop of which the outer diameter of the curl diameter is increased, so that a binding defect of imperfectly binding the reinforcing bars is caused. Also, twisting torque of the pair of twisting hooks set in the reinforcing bar binding machine is set in conformity to the defined number of winding times. Therefore, when only the curl part wound last is unwound, the pair of twisting hooks twists the wire loop with a number of winding times (for example, two times) smaller than the defined number of winding times (for example, three times), so that the wire loop may be twisted and cut. Although the wire loop is not cut, the curl part wound last, which has been unwound from the twisted part, protrudes in a whisker shape, so that the binding form of the wire is damaged and a bad influence is caused in the concrete (which will be described later).

Also, even when the wire is wound and then cut, the wire loop may be maintained in the appropriate loop shape. When the pair of twisting hooks of the reinforcing bar binding machine once twists and binds the one end of the wire loop with the defined number of winding times (for example, two times), an appropriate binding shape is obtained in which a twisted part wound two times of which both ends are uniformly wound is formed and both ends intersect at a position opposite to the twisted part. However, since both ends of the wire loop are at a free state, when one end of the wire loop is twisted and bound, a part of the wire at a cut end portion (hereinafter, referred to as termination portion)-side of the cut and separated wire is swung around with the variation upon the twisting and cannot be thus uniformly wound to the twisted part, so that the appropriate binding shape may not be obtained. Also, a twisted part wound one time, rather than the twisted part wound two times, is formed, so that it may be twisted and cut with the twisting torque of the pair of twisting hooks due to the insufficient strength. Even though the twisted part is not cut, it is not possible to secure the binding force of the twisted part wound two times, which is originally intended, with the twisted part wound one time. Therefore, the two reinforcing bars bound and fixed may be loosened, so that the binding should be again performed.

The reinforcing bar binding machine is configured to twist the wire and to bind the reinforcing bars after cutting the wire. Therefore, while twisting the wire, a start end portion and a cut termination portion of the wire wound around the reinforcing bars are at a free state, as described above. The start end portion and termination portion (both end portions) of the wire are positioned at a substantially opposite side distant from the part that is twisted by the twisting hooks, and may protrude in a lateral direction of the wire loop due to an influence upon the twisting. In this case, after the twisting of the wire is over, when pulling out the reinforcing bar binding machine so as to detach the guide part from the reinforcing bars, any one or both of the start end portion and termination portion of the wire at the free state are hooked at the guide part and the like and are bent and moved towards the twisted part of the reinforcing bar. Also, the end portion of the wire is escaped to the twisted part-side and is separated from the reinforcing bars, so that an outward appearance may be deteriorated. Further, when the concrete is poured at this state, the end portion of the wire may protrude from a concrete surface. When the end portion of the wire is exposed from the concrete surface, the rainwater is introduced into an inside through a gap between the wire and the concrete and causes a crack. Therefore, for the reinforcing bar binding machine, a holding device is required with which the end portion is held and the appropriate loop shape is maintained even after the wire is cut, the cut end portion is wound around the twisted part during the binding and does not damage the appropriate binding shape and the end portion of the wire can be smoothly pulled out from the guide part when pulling out the guide part from the bound reinforcing bars.

Also, according to the reinforcing bar binding machine of the related art, when the wire cutting mechanism cuts the wire, the moveable blade slides relative to the fixed blade to cut the wire. However, since the wire is supported with a cantilever of the fixed blade, the wire is bent in a cutting direction of the moveable blade upon the cutting, so that the wire may not be cut. Also, the wire is bent and sandwiched between the moveable blade and the fixed blade, so that the problems such as the damages of the moveable blade and fixed blade are caused in the wire cutting mechanism.

Also, according to the reinforcing bar binding machine of the related art, as described above, since the wire is supported with the cantilever of the fixed blade, the wire is applied with load in a cutting direction of the moveable blade upon the cutting, so that the wire is cut with being deformed. Therefore, the force beyond the load necessary for the cutting is required. For this reason, the reinforcing bar binding machine of the related art has problems that the durability of the moveable blade is degraded and the cutting performance of the moveable blade is deteriorated due to the wear.

It is therefore an object of the present invention to provide a reinforcing bar binding machine capable of holding a cut end portion-side of a wire cut and separated by a wire cutting mechanism to maintain an appropriate loop shape of the wire, holding the wire to securely keep both end portions of the wire on back sides of reinforcing bars during the wire binding, and preventing both end portions of the wire from protruding from the bound wire loop.

It is therefore an object of the present invention to provide a reinforcing bar binding machine capable of supporting both sides of a wire cutting part with both a moveable blade and a fixed blade to remove a cause of a cutting defect and to prevent a problem from occurring in a wire cutting mechanism when cutting the wire by the wire cutting mechanism, improving durability of the wire cutting mechanism to maintain cutting performance of the moveable blade, and performing secure and smooth the cutting operation.

(1) A reinforcing bar bending machine is configured to detachably mount a wire reel thereto, to feed a wire from the mounted wire reel, to feed the wire to a guide part provided at a tip portion of a binding machine main body, to curl the wire at the guide part, to feed the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter including a fixed blade and a moveable blade which is configured to slide or swing to the fixed blade to cut the wire or which is configured to rotate inside the fixed blade to cut the wire. The guide part is provided with a holding device which is configured to hold a cut end portion-side of the wire cut and separated in conjunction with a cutting operation of the moveable blade. The holding device is configured to bend and hold the cut end portion-side of the cut and separated wire.

(2) The reinforcing bar binding machine according to (1), the wire cutting mechanism includes the fixed blade which has a wire penetration hole penetrated in a feeding direction of the wire and the moveable blade which is configured to slide or swing to the fixed blade and to cut the wire. The holding device is a bending part formed at a tip portion of the moveable blade and configured to bend and hold the cut end portion-side of the cut and separated wire.

(3) The reinforcing bar binding machine according (1), the wire cutting mechanism includes the moveable blade which has a wire penetration hole penetrated in a feeding direction of the wire and the fixed blade which is configured to rotatably accommodate the moveable blade. A wire entry opening-side of the wire penetration hole slides to the fixed blade by a rotation of the moveable blade and cuts and separates the wire. The holding device is an end portion edge of a wire exit opening of the wire penetration hole of the moveable blade configured to bend and hold the cut end portion-side of the cut and separated wire.

(4) A reinforcing bar bending machine is configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The guide part is provided with a holding device which is configured to hold a cut end portion-side of the wire cut and separated in conjunction with a cutting operation of the wire cutting mechanism. The holding device is configured by a contact part configured to contact the cut end portion-side of the wire cut and separated by the wire cutting mechanism.

(5) The reinforcing bar binding machine according to (4), the wire cutting mechanism includes a fixed blade which has a wire penetration hole penetrated in a feeding direction of the wire and a moveable blade which is configured to slide or swing to the fixed blade and to cut the wire. The holding device is configured by the moveable blade and the contact part. The contact part is configured to contact and to bend the cut end portion-side of the wire cut and separated by the moveable blade.

(6) The reinforcing bar binding machine according to (4), the wire cutting mechanism includes a fixed blade which has a wire penetration hole penetrated in a feeding direction of the wire and a moveable blade which is configured to slide or swing to the fixed blade and to cut the wire. The holding device is the contact part configured to be contacted and engaged with the cut end portion-side of the wire bent by a bending part formed at a tip portion of the moveable blade.

(7) The reinforcing bar binding machine according to (4), the wire cutting mechanism includes a moveable blade which has a wire penetration hole penetrated in a feeding direction of the wire and a fixed blade which is configured to rotatably accommodate the moveable blade. A wire entry opening-side of the wire penetration hole slides to the fixed blade by a rotation of the movable blade and cuts and separates the wire. The holding device is configured by an end portion edge of a wire exit opening of the moveable blade and the contact part. The contact part is configured to contact the cut end portion-side of the cut and separated wire.

(8) The reinforcing bar binding machine according to (4), the wire cutting mechanism includes a fixed blade which has a wire penetration hole penetrated in a feeding direction of the wire and a moveable blade which is provided to be rotatable around the fixed blade. The moveable blade slides to a wire exit opening-side of the wire penetration hole of the fixed blade by a rotation of the movable blade and cuts and separates the wire. The holding device is configured by the moveable blade and the contact part. The contact part is configured to contact the cut end portion-side of the cut and separated wire.

(9) The reinforcing bar binding machine according to (4), the contact part is a support member which is configured to support the wire. The guide part is provided with the support member configured to support the wire to be fed from the wire cutting mechanism at a downstream-side position of a cutting part of the wire cutting mechanism in a feeding direction of the wire. The support member is configured to support the wire upon wire cutting of the wire cutting mechanism.

(10) The reinforcing bar binding machine according to (9), the guide part is provided with a fixed member configured to support the wire at an upstream-side position of the cutting part of the wire cutting mechanism in the feeding direction of the wire. The fixed member is configured to support one side of a wire cutting part upon the wire cutting. The support member is configured to support the other side of the wire cutting portion upon the wire cutting.

(11) The reinforcing bar binding machine according to (9), the wire cutting mechanism is a cutter including a first moveable blade and a second moveable blade configured to slide or swing to the first moveable blade and to cut the wire. The first moveable blade or the second moveable blade is configured to support one side of a wire cutting part upon the wire cutting. The support member is configured to support the other side of the wire cutting portion upon the wire cutting.

(12) The reinforcing bar binding machine according to (9), the wire cutting mechanism is a cutter including a fixed blade and a moveable blade configured to slide or swing to the fixed blade and to cut the wire. The fixed blade is configured to support one side of a wire cutting part upon the wire cutting. The support member is configured to support the other side of the wire cutting portion upon the wire cutting.

(13) The reinforcing bar binding machine according to (9), the wire cutting mechanism includes a fixed blade and a moveable blade. The fixed blade is formed with a wire penetration hole penetrated in the feeding direction of the wire. The wire is configured to be fed from the wire penetration hole of the fixed blade. The moveable blade is configured to operate at a wire exit opening-side of the wire penetration hole of the fixed blade and to cut the wire. The fixed blade is configured to support one side of a wire cutting part upon the wire cutting. The support member is configured to support the other side of the wire cutting portion upon the wire cutting.

(14) The reinforcing bar binding machine according to (9), the wire cutting mechanism is a cutter including a fixed blade and a moveable blade provided to be rotatable around the fixed blade, the fixed blade being formed with a wire penetration hole penetrated in the feeding direction of the wire, the wire being configured to be fed from the wire penetration hole of the fixed blade, the cutter being configured to cut the wire by a rotation of the moveable blade. The fixed blade is configured to support one side of a wire cutting part upon the wire cutting. The support member is configured to support the other side of the wire cutting portion upon the wire cutting.

(15) The reinforcing bar binding machine according to (9), the wire cutting mechanism is a cutter including a fixed blade and a rotatable moveable blade accommodated inside the fixed blade, the moveable blade being formed with a wire penetration hole penetrated in the feeding direction of the wire, the wire being configured to be fed from the wire penetration hole of the moveable blade, the cutter being configured to cut the wire by a rotation of the moveable blade. The fixed blade is configured to support one side of a wire cutting part upon the wire cutting. The support member is configured to support the other side of the wire cutting portion upon the wire cutting.

(16) The reinforcing bar binding machine according to any one of (9) to (15), the guide part is provided with a curling mechanism configured to curl the wire. The curling mechanism is provided with a plurality of guide members configured to guide an outer surface which is an outer side of wire to be bent and an inner surface which is an inner side of the wire to be bent. At least one of the guide members configures the support member.

(17) A reinforcing bar bending machine is configured to detachably mount a wire reel thereto, to feed a wire from the mounted wire reel, to feed the wire to a guide part provided at a tip portion of a binding machine main body, to curl the wire at the guide part, to feed the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter including a fixed blade and a moveable blade. The guide part is provided with a holding device which is configured to hold a cut end portion-side of the wire cut and separated in conjunction with a cutting operation of the moveable blade. The holding device is a holding member which is coupled by a link mechanism and which is configured to press the cut end portion-side of the wire separated by the moveable blade toward a side surface-side of a wire guide passage.

(18) The reinforcing bar binding machine according to (17), the wire cutting mechanism includes the fixed blade having a wire penetration hole penetrated in a feeding direction of the wire and the moveable blade configured to slide or swing to the fixed blade and to cut the wire. The holding device is the pressing part of the holding member formed at one side of the moveable blade and configured to press the cut end portion-side of the cut and separated wire toward the side surface-side of the wire guide passage.

(19) The reinforcing bar binding machine according to (18), the holding device is configured so that the pressing part presses and holds the cut end portion-side of the cut and separated wire toward the side surface-side of the wire guide passage.

(20) The reinforcing bar binding machine according to (17), the wire cutting mechanism includes the fixed blade having a wire penetration hole penetrated in a feeding direction of the wire and the moveable blade provided to be rotatable around the fixed blade. The holding device is the holding member which is coupled by the moveable blade and the link mechanism and which is configured to press the cut end portion-side of the wire separated by the moveable blade toward the side surface-side of the wire guide passage.

(21) The reinforcing bar binding machine according to (20), the holding device is configured so that the holding member presses and holds the cut end portion-side of the cut and separated wire toward the side surface-side of the wire guide passage.

(22) The reinforcing bar binding machine according to (17), the wire cutting mechanism includes the moveable blade having a wire penetration hole penetrated in a feeding direction of the wire and the fixed blade configured to rotatably accommodate the moveable blade. The holding device is the holding member which is coupled by the moveable blade and the link mechanism and which is configured to press the cut end portion-side of the wire cut and separated by the moveable blade toward the side surface-side of the wire guide passage.

(23) The reinforcing bar binding machine according to (22), the holding device is configured so that the holding member presses and holds the cut end portion-side of the cut and separated wire toward the side surface-side of the wire guide passage.

(24) The reinforcing bar binding machine according to (17), the holding device is the holding member which is coupled to a driving part of a binding machine main body by the link mechanism and which is configured to press the cut end portion-side of the wire separated by the moveable blade toward the side surface-side of the wire guide passage.

(25) The reinforcing bar binding machine according to (24), the holding device is configured so that the holding member presses and holds the cut end portion-side of the cut and separated wire toward the side surface-side of the wire guide passage.

According to the reinforcing bar binding machine of the present invention, after the wire is fed out around the reinforcing bars so that the wire is wound around the reinforcing bars into a loop shape, the wire is cut by the wire cutting mechanism. However, since the cut end portion-side of the cut and separated wire is held by the holding device, the cut end portion of the wire loop is not a free state, so that the wire loop is not loosened and the appropriate annular shape of the wire loop can be kept. Also, since the appropriate annular shape of the wire loop is kept before the binding, a binding defect is not caused well. Also, even during the binding of the wire loop, since the cut end portion-side of the wire is held, a part of the wire at the cut end portion-side is not involved into the twisting part, so that the appropriate binding shape is obtained. Like this, the reinforcing bar binding machine of the present invention can hold the cut end portion-side of the wire cut and separated by the wire cutting mechanism to hold the appropriate loop shape of the wire, hold the cut end portion-side of the wire to enable both end portions of the wire to stay on the back sides of the reinforcing bars during the wire binding, and prevent both end portions of the wire from protruding from the bound wind loop.

The reinforcing bar binding machine of the present invention is provided with the support member configured to support the wire fed out from the wire cutting mechanism-side at the downstream-side position of the cutting part of the wire cutting mechanism with respect to the feeding direction of the wire, and the support member is configured to support the wire upon the wire cutting of the wire cutting mechanism. That is, according to the reinforcing bar binding machine of the present invention, upon the wire cutting of the wire cutting mechanism, since the wire is supported by the support member, the wire is not bent in the cutting direction upon the wire cutting and the secure and smooth cutting operation can be performed. Also, according to the reinforcing bar binding machine of the present invention, since the wire to be cut by the wire cutting mechanism is supported by the support member, the load is enough for the cutting so that the wire is not deformed upon the cutting even when the load is applied thereto in the cutting direction. Also, it is possible to prevent the durability of the wire cutting mechanism from being degraded and the cutting performance of the wire cutting mechanism from being deteriorated due to the wear.

According to the reinforcing bar binding machine of the present invention, the guide part is provided with the fixed member configured to support the wire at the upstream-side position of the cutting part of the wire cutting mechanism with respect to the feeding direction of the wire. The fixed member is configured to support one side of the wire cutting part upon the wire cutting, and the support member is configured to support the other side of the wire cutting portion upon the wire cutting. That is, according to the reinforcing bar binding machine of the present invention, since both sided of the wire cutting part are supported by the fixed member and the support member upon the wire cutting of the wire cutting mechanism, the wire is not bent in the cutting direction upon the wire cutting and the secure and smooth cutting operation can be performed. Also, according to the reinforcing bar binding machine of the present invention, since both sides of the cutting part of the wire to be cut by the wire cutting mechanism are supported by a both-end support method of the fixed member and the support member, the wire is not deformed even when the load is applied thereto in the cutting direction upon the cutting and the load is enough for the cutting. Also, it is possible to prevent the durability of the wire cutting mechanism from being degraded and the cutting performance of the wire cutting mechanism from being deteriorated due to the wear.

According to the reinforcing bar binding machine of the present invention, the wire cutting mechanism is a cutter including the first moveable blade and the second moveable blade configured to slide or swing to the first moveable blade and to cut the wire, the first moveable blade or second moveable blade is configured to support one side of the wire cutting part upon the wire cutting, and the support member is configured to support the other side of the wire cutting portion upon the wire cutting. That is, according to the reinforcing bar binding machine of the present invention, since both sides of the wire cutting part are supported by the first or second moveable blade and the support member upon the wire cutting of the pair of moveable blades, the wire is not bent in the cutting direction upon the cutting and the secure and smooth cutting can be performed. Also, since the wire is not bent in the cutting direction upon the cutting, it is possible to prevent the problem of the wire cutting mechanism that the wire is bent and sandwiched between the first moveable blade and the second moveable blade and the first and second moveable blades are damaged, for example. Also, according to the reinforcing bar binding machine of the present invention, since both sides of the cutting part of the wire to be cut by the pair of moveable blades are supported by a both-end support method of the first or second moveable blade and the support member, the wire is not deformed even when the load is applied thereto in the cutting direction upon the wire cutting and the load is enough for the cutting. Also, it is possible to prevent the durability of the pair of moveable blades from being degraded and the cutting performance of the pair of moveable blades from being deteriorated due to the wear.

According to the reinforcing bar binding machine of the present invention, the wire cutting mechanism is a cutter including the fixed blade and the moveable blade configured to slide or swing to the fixed blade and to cut the wire, the fixed blade is configured to support one side of the wire cutting part upon the wire cutting, and the support member is configured to support the other side of the wire cutting portion upon the wire cutting. That is, according to the reinforcing bar binding machine of the present invention, since both sides of the wire cutting part are supported by the fixed blade and the support member upon the wire cutting of the moveable blade, the wire is not bent in the cutting direction upon the cutting and the secure and smooth cutting can be performed. Also, since the wire is not bent in the cutting direction of the moveable blade upon the cutting, it is possible to prevent the problem of the wire cutting mechanism that the wire is bent and sandwiched between the moveable blade and the fixed blade and the moveable blade and the fixed blade are damaged, for example. Also, according to the reinforcing bar binding machine of the present invention, since both sides of the cutting part of the wire to be cut by the moveable blade are supported by a both-end support method of the fixed blade and the support member, the wire is not deformed even when the load is applied thereto in the cutting direction of the moveable blade upon the wire cutting and the load is enough for the cutting. Also, it is possible to prevent the durability of the moveable blade from being degraded and the cutting performance of the moveable blade from being deteriorated due to the wear.

According to the reinforcing bar binding machine of the present invention, the guide part is provided with the plurality of guide members configured to guide the outer surface of the wire becoming a bent outer side thereof and the inner surface of the wire becoming a bent inner side thereof. Therefore, it is possible to curl the wire by the guide members so that a curl diameter of the wire to be wound around the reinforcing bars into a loop shape is substantially constant. For this reason, the binding defect is reduced, so that it is possible to keep the stable wire binding. Also, at least one of the guide members is configured as the support member. Thereby, it is not necessary to form a separate support member, so that the cost is saved. Also, the secure and smooth cutting operation can be performed.

DETAILED DESCRIPTION

Figure 1:
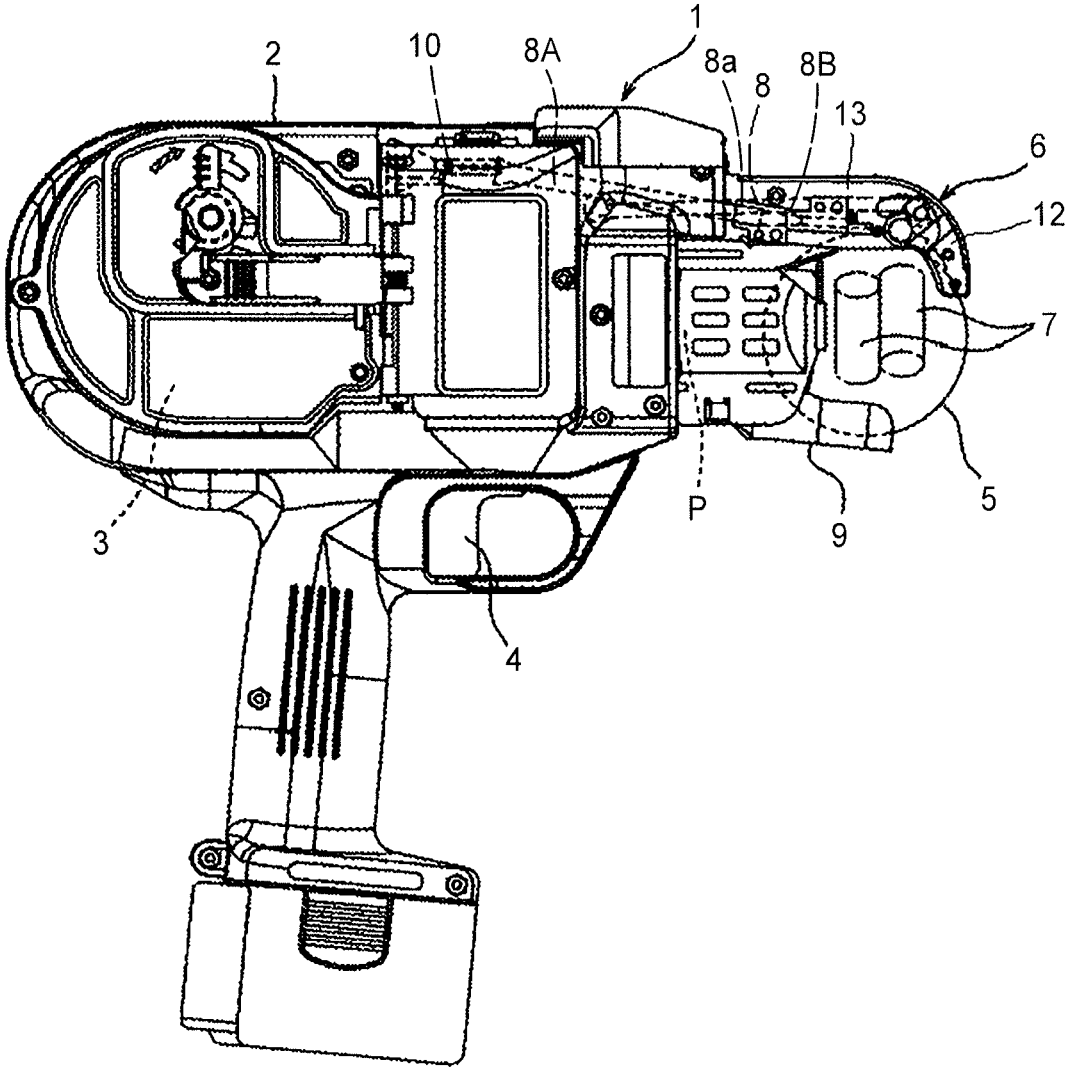
FIG. 1 is a side view illustrating an illustrative embodiment of a reinforcing bar binding machine of the present invention.
Figure 2:
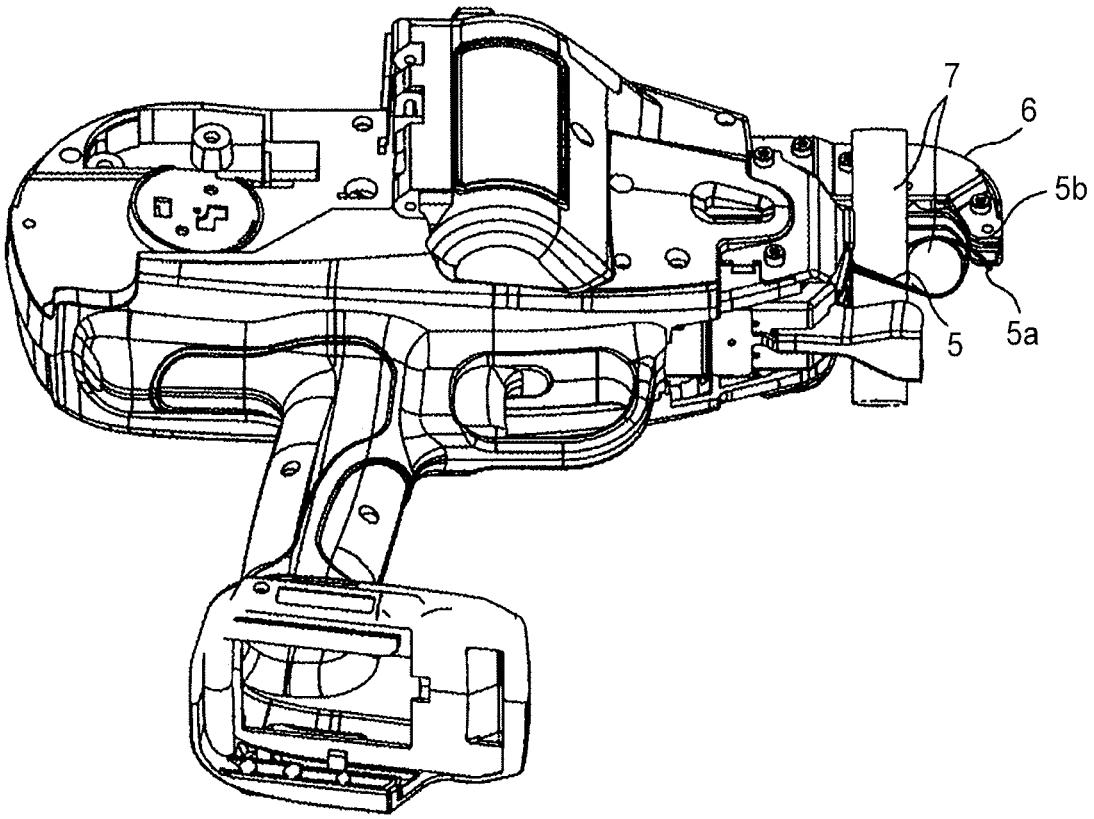
FIG. 2 is a perspective view of the reinforcing bar binding machine of FIG. 1, as obliquely seen from below.

Hereinafter, the reinforcing bar binding machine will be described in detail. As shown in FIG. 1, a reinforcing bar binding machine 1 has a binding machine main body 2 and a guide part 6 attached to a tip portion of the binding machine main body 2. The binding machine main body 2 has an accommodation chamber 3 configured to accommodate therein a wire reel, a wire feeding device 10 configured to feed a wire 5 of the wire reel mounted in the accommodation chamber 3 and to feed the same to the guide part 6, and a trigger 4 configured to operate the wire feeding device 10. When the trigger 4 is operated, the wire feeding device 10 drives an electric motor (not shown), so that a feeding roller feeds out the wire 5 of the wire reel forwards.

Figure 3:
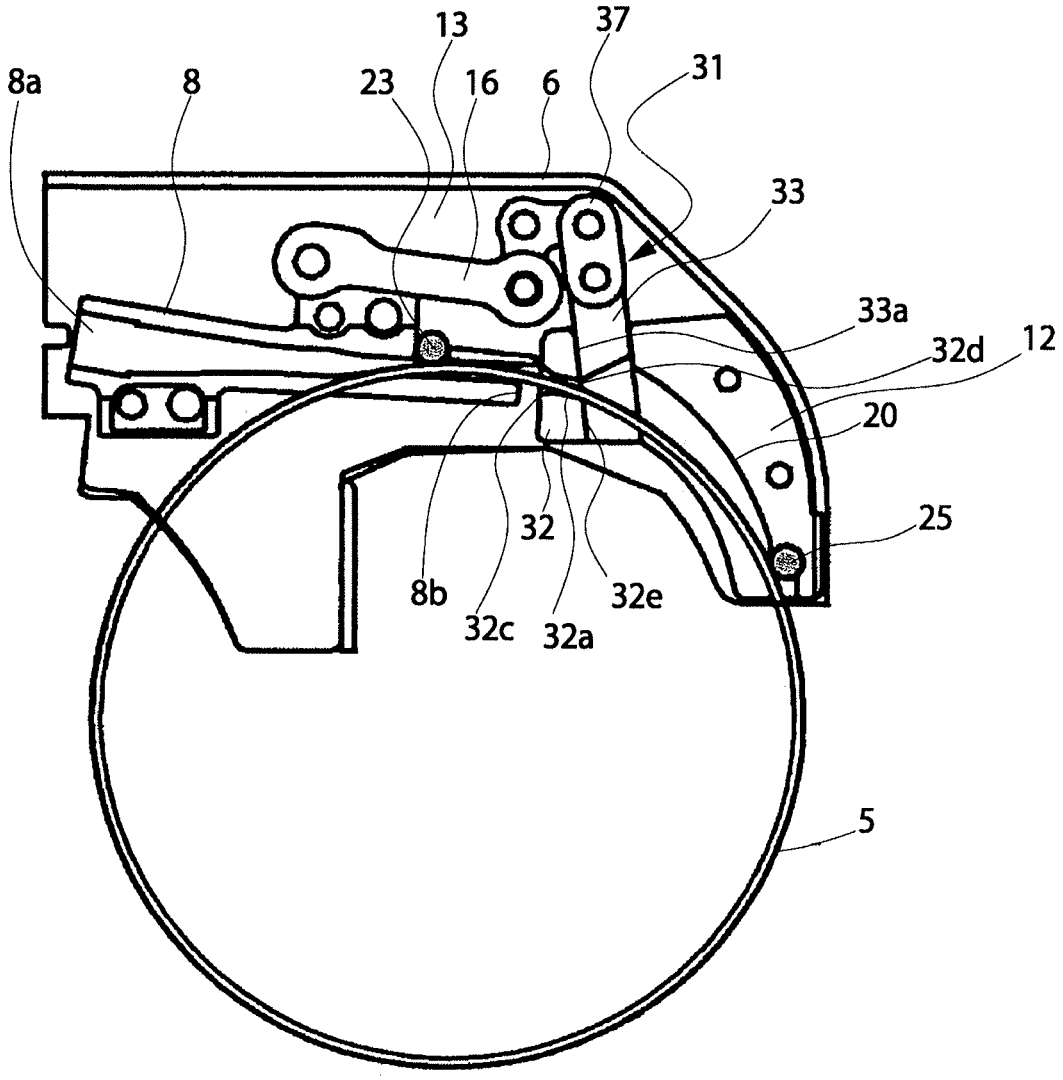
FIG. 3 is a side view illustration for illustrating one wire cutting mechanism of the reinforcing bar binding machine.

The guide part 6 is provided with a gently curved guide frame 13. As shown in FIG. 3, on a wire feeding path of the guide frame 13, a guide component (guide pipe) 8 configured to guide and feed out the wire 5 pulled out from the wire reel by the wire feeding device, a wire cutting mechanism 31 configured to feed out a predetermined length of the wire 5 by the wire feeding device, to wind the wire around reinforcing bars 7 and then to cut the wire, and a curl guide 12 configured to bend the wire 5 fed via the wire cutting mechanism 31 are sequentially arranged and fixed. The curl guide 12 is fixed to a tip-side of the guide frame 13 and is formed with a guide recess 20 for guiding the wire 5 in a curling direction in cooperation with the guide frame 13.

As shown in FIG. 3, when a feeding length of the wire 5 reaches a predetermined amount, the wire cutting mechanism 31 cuts the wire 5. The wire cutting mechanism 31 is a slide cutter of a sliding-type cutting mechanism having a fixed blade 32 fixed to the guide frame 13, a moveable blade 33 configured to slide to the fixed blade 32 and to cut the wire 5 and a driving lever 16 configured to move the moveable blade 33 through a link mechanism 37.

The fixed blade 32 is formed with a wire penetration hole 32*a* through which the wire 5 passes in a feeding direction of the wire 5. One end of the wire penetration hole 32*a* opens towards a tip 8*b* of the guide component (guide pipe) 8, and the other end opens towards the curl guide 12. The one end-side opening of the wire penetration hole 32*a* is a wire entry opening 32*c*, and the other end-side opening of the wire penetration hole 32*a* is a wire exit opening 32*d*.

The wire cutting mechanism 31 is configured to move downwards (from an outer side towards an inner side of a curve of the wire) the moveable blade 33 through the link mechanism 37 by the driving lever 16, to enable one surface 33*a* of the moveable blade 33 to slide downwards along a surface 32*e* of the wire exit opening 32*d*-side of the wire penetration hole 32*a* of the fixed blade 32, and to enable a lower end edge of the one surface 33*a* of the moveable blade 33 to cut the wire 5 having passed through the wire penetration hole 32*a*.

Figure 4:
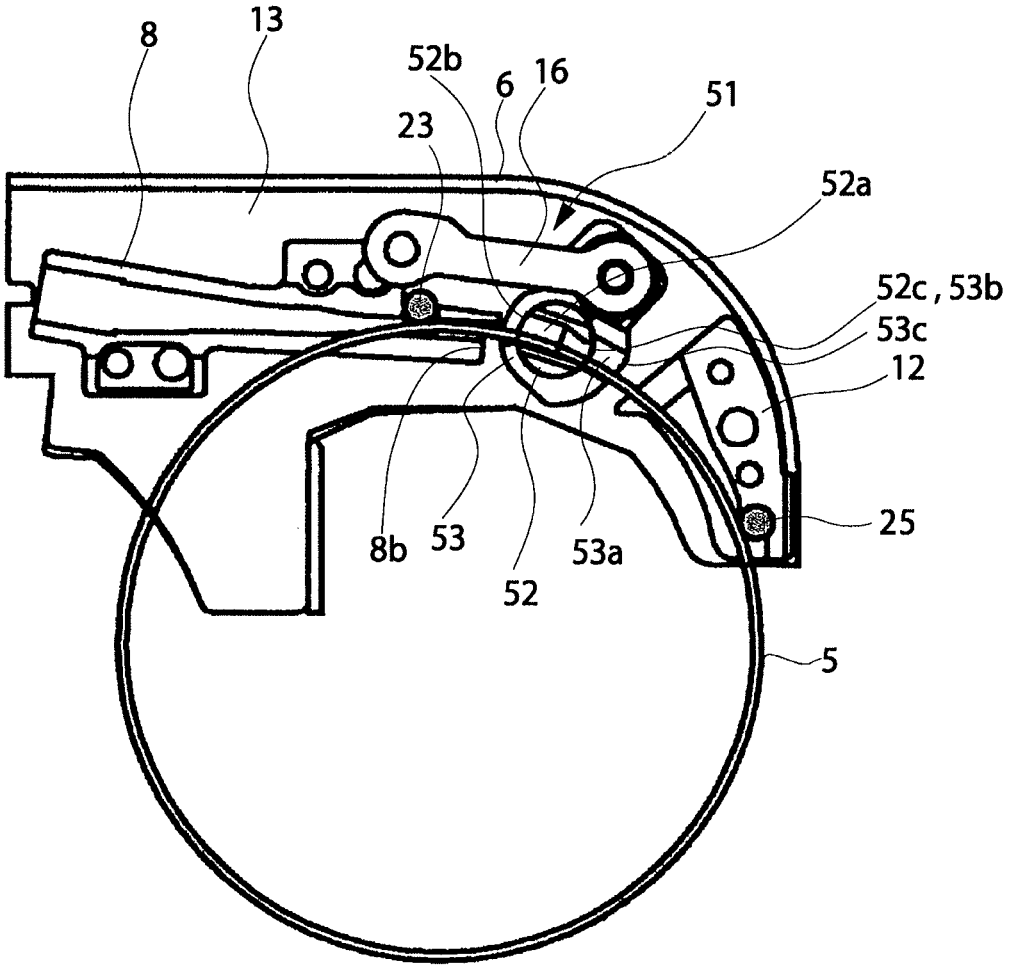
FIG. 4 is a side view illustration for illustrating another wire cutting mechanism of the reinforcing bar binding machine.

The wire cutting mechanism of the reinforcing bar binding machine is also used as a rotary cutter of a rotation-type cutting mechanism, in addition to the slide cutter of the sliding-type cutting mechanism. As shown in FIG. 4, when a feeding length of the wire 5 reaches a predetermined amount, a wire cutting mechanism 51 cuts the wire 5. The wire cutting mechanism 51 is a rotary cutter having a circular shaft-shaped moveable blade 52 provided to be rotatable, a fixed blade 53 configured to rotatably accommodate the circular shaft-shaped moveable blade 52 and a driving lever 16 configured to rotate the moveable blade 52.

The circular shaft-shaped moveable blade 52 is formed with a wire penetration hole 52*a* penetrated in the feeding direction of the wire 5. One end of the wire penetration hole 52*a* opens towards the tip 8*b* of the guide pipe 8, and the other end opens towards the curl guide 12. The one end-side opening of the wire penetration hole 52*a* is a wire entry opening 52*b*, and the other end-side opening of the wire penetration hole 52*a* is a wire exit opening 52*c*. Also, the fixed blade 53 is formed with a wire insertion penetration hole 53*a* penetrated in the feeding direction of the wire 5. One end of the wire insertion penetration hole 53*a* opens towards the wire exit opening 52*c* of the wire penetration hole 52*a* of the moveable blade 52, and the other end opens towards the curl guide 12. The one end-side opening of the wire insertion penetration hole 53*a* of the fixed blade 53 is a wire entry opening 53*b*, and the other end-side opening of the wire insertion penetration hole 53*a* is a wire discharge opening 53*c*.

The wire cutting mechanism 51 is configured to rotate the moveable blade 52 in a counterclockwise direction by the driving lever 16, to enable a surface of the wire exit opening 52*c*-side of the moveable blade 52 to slide upwards along a surface of the wire entry opening 53*b*-side of the fixed blade 53, and to enable a lower end edge of the wire exit opening 52*c* of the moveable blade 52 to cut the wire 5 having passed through the wire penetration hole 52*a*.

The wire cutting mechanism of the reinforcing bar binding machine may have a configuration where the fixed blade and the moveable blade of the wire cutting mechanism may be reversed as regards the configurations thereof in the rotary cutter of the rotation-type cutting mechanism. That is, the wire cutting mechanism 51 may be configured as a rotary cutter having a circular shaft-shaped fixed blade 52 fixed to the guide frame 13, a moveable blade 53 provided to be rotatable around the fixed blade 52 and a driving lever 16 configured to rotate the moveable blade 53.

In this case, the circular shaft-shaped fixed blade 52 is formed with a wire penetration hole 52*a* penetrated in the feeding direction of the wire 5. One end of the wire penetration hole 52*a* opens towards the tip 8*b* of the guide component 8, and the other end opens towards the curl guide 12. The one end-side opening of the wire penetration hole 52*a* is a wire entry opening 52*b*, and the other end-side opening of the wire penetration hole 52*a* is a wire exit opening 52*c*. Also, the moveable blade 53 is formed with a wire insertion penetration hole 53*a* penetrated in the feeding direction of the wire 5. One end of the wire insertion penetration hole 53*a* opens towards the wire exit opening 52*c* of the wire penetration hole 52*a* of the fixed blade 52, and the other end opens towards the curl guide 12. The one end-side opening of the wire insertion penetration hole 53*a* of the moveable blade 53 is a wire entry opening 53*b*, and the other end-side opening of the wire insertion penetration hole 53*a* is a wire discharge opening 53*c*.

The wire cutting mechanism 51 is configured to rotate the moveable blade 53 in a counterclockwise direction by the driving lever 16, to enable a surface of the wire entry opening 53*b*-side of the moveable blade 53 to slide upwards along a surface of the wire exit opening 52*c*-side of the fixed blade 52, and to enable a lower end edge of the wire entry opening 53*b* of the moveable blade 53 to cut the wire 5 having passed through the wire penetration hole 52*a*.

As shown in FIG. 3, the guide component (guide pipe) 8 has one end 8*a* opening towards the accommodation chamber 3 and the other end (tip) 8*b* opening the wire cutting mechanism 31 (or 51). The other end 8*b*-side opening of the guide component (guide pipe) 8 is narrowed, as compared to the one end 8*a*-side opening, so that the wire 5 is led out from a predetermined position. Also, a side surface of the guide frame 13 may be configured to also serve as a sidewall of the guide component 8. Also, the guide component 8 includes a guide component (guide pipe) A(8A) arranged at a feeding roller-side of the wire feeding device 10 and a guide component B(8B) arranged at the guide frame 13-side. The guide pipe A(8A) has one end positioned in the vicinity of the feeding roller of the wire feeding device 10 and the other end fitted and inserted in the one end 8*a*-side opening of the guide component B(8B). The guide pipe A(8A) and the guide component B(8B) are integrally formed and configure a part of a guide on a wire feeding path for feeding the wire 5 from the feeding roller-side of the wire feeding device 10 towards the guide frame 13. Also, the guide pipe A(8A) and the guide component B(8B) may be configured as a unitary guide component 8. The curl guide 12 is curved into an arc shape and is configured to curl the wire 5 fed out from the wire feeding device 10 of the binding machine main body 2 and to circulate the wire around the reinforcing bars 7 between the curl guide and a lower guide 9 shown in FIG. 1. Also, the guide part 6 is provided next to the curl guide 12 with a curl pickup guide configured to pick up a start end portion of the wire 5 fed out from the curl guide 12 and completely wound in a loop shape and to again guide the same for next winding feeding.

The binding machine main body 2 is provided with a wire twisting device configured to twist the wire 5 wound in a loop shape around the reinforcing bars and to bind the reinforcing bars. The wire twisting device is configured to advance a sleeve, which is pivotally secured to open or close a pair of hooks provided for a P part shown in FIG. 1, by the electric motor to thus close the hooks, to grip the wire 5 wound in a loop shape around the reinforcing bars, to rotate the hooks together with the sleeve to thus twist the wire 5 and to bind the reinforcing bars, and then to open the hooks, to retreat and separate the sleeve from the wire and to return the sleeve to an initial position. When the sleeve is advanced to pick up the wire loop, the wire twisting device operates the driving lever 16 of the wire cutting mechanism 11 (or 51), thereby cutting (shearing) the wire 5.

In this way, the reinforcing bar binding machine 1 is configured to mount the wire reel, around which the wire 5 for binding reinforcing bars is wound, to the accommodation chamber 3 provided for the binding machine main body 2, to rotate the wire reel, as the trigger 4 is pulled, to feed the wire 5 to the guide part 6 provided at the tip portion of the binding machine main body 2, to curl the wire 5 at the guide recess 20 of the curl guide 12 of the guide part 6, to feed out the wire around the reinforcing bars 7 arranged at an inner side of the guide part 6 so that the wire is wound around the reinforcing bars, to cut the end-side of the wire 5, and to twist the wound part to thus bind the reinforcing bars 7.

Also, as shown in FIG. 3, a first guide member 23 serving as a first curling guide member is provided at an end portion of the guide component (guide pipe) 8 or a notched upper part of the guide component (guide passage) 8. The first guide member 23 protrudes towards an inside (guide path) of the guide component (guide pipe) 8. Thereby, an outer surface of the wire 5 becoming a bent outer side thereof is guided by the first guide member 23.

Also, a third guide member 25 serving as a third curling guide member is provided inside a tip portion of the curl guide 12. The third guide member 25 is attached to protrude more inwardly than a guide surface 21 of the curl guide 12. Therefore, the bending outer surface of the wire 5 fed out along the guide recess 20 of the curl guide 12 is fed downwards with contacting the third guide member 25. Also, the first and third guide members 23, 25 are preferably made of a high hardness material such as carbide pins (cemented carbide pins or ceramic pins).

As described above, the wire fed out from the guide component (guide pipe) 8 is contacted to the first guide member 23 arranged at the tip 8*b*-side of the guide component (guide pipe) 8 or the notched upper part of the guide component (guide pipe) 8, passes through the wire cutting mechanism 31 (or 51), is fed out along the inner surface of the curl guide 12 and is contacted to the third guide member 25, so that the wire 5 is strongly bent. In this way, the wire 5 is contacted to the first and third guide members 23, 25 of high hardness.

According to the reinforcing bar binding machine 1, when cutting the wire 5 by the wire cutting mechanism 31; 51, the moveable blade 33; 53 slides relative to the fixed blade 32; 52, so that the wire is cut. However, since the wire 5 is supported with a cantilever of the fixed blade 32; 52, the wire 5 of the free end-side is bent in a cutting direction of the moveable blade 33; 53 upon the cutting, so that the wire may not be cut. Also, the wire 5 is bent and sandwiched between the moveable blade 33; 53 and the fixed blade 32; 52, so that the problems such as the damages of the moveable blade 33; 53 and fixed blade 32; 52 may be caused in the wire cutting mechanism 31; 51. Also, since the wire 5 is supported with the cantilever of the fixed blade 32; 52, the wire of the free end-side is applied with load in the cutting direction of the moveable blade 33; 53 upon the cutting, so that the wire is cut with being deformed. Therefore, the force beyond the load necessary for the cutting is required. For this reason, the durability of the moveable blade 33; 53 is degraded and the cutting performance of the moveable blade 33; 53 is deteriorated due to the wear.

Therefore, the reinforcing bar binding machine 1 is provided with a support member configured to support the other side of the wire cutting part upon the wire cutting with one side of the wire cutting part being supported with the fixed blade. Thereby, when cutting the wire by the wire cutting mechanism, both sides of the wire cutting part are supported with the fixed blade and the support member. As a result, it is possible to remove the causes of the cutting defect, to prevent the problems from occurring in the wire cutting mechanism, to improve the durability of the wire cutting mechanism, to keep the cutting performance of the moveable blade and to securely and smoothly perform the cutting operation.

Figure 5:
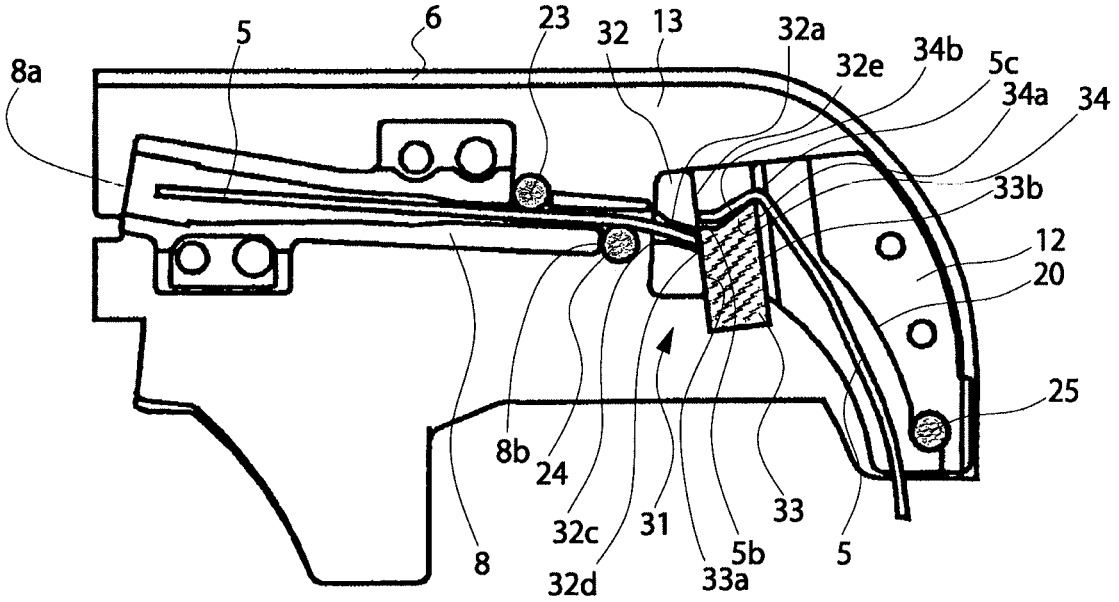
FIG. 5 is a side view illustrating a first illustrative embodiment of an internal configuration of a guide part of the reinforcing bar binding machine.

A first illustrative embodiment of the guide part 6 is described. As shown in FIG. 5, when a feeding length of the wire 5 reaches a predetermined amount, the wire cutting mechanism 11 cuts the wire 5. The wire cutting mechanism 31 is a slide cutter having the fixed blade 32 fixed to the guide frame 13, the moveable blade 33 configured to slide to the fixed blade 32 and to cut the wire, and the driving lever 16 configured to move the moveable blade 33.

The fixed blade 32 is formed with the wire penetration hole 32*a* penetrated in the feeding direction of the wire 5. One end of the wire penetration hole 32*a* opens towards the tip portion 8*b* of the guide pipe 8, and the other end opens towards the curl guide 12. The one end-side opening of the wire penetration hole 32*a* is the wire entry opening 32*c*, and the other end-side opening of the wire penetration hole 32*a* is the wire exit opening 32*d*.

The wire cutting mechanism 31 is configured to move upwards (from an inner side towards an outer side of a curve of the wire) the moveable blade 33 by the driving lever 16, to enable one surface 33*a* of the moveable blade 33 to slide upwards along the surface 32*e* of the wire exit opening 32*d*-side of the wire penetration hole 32*a* of the fixed blade 32, and to enable an upper end edge of the one surface 33*a* of the moveable blade 33 to cut the wire 5 having passed through the wire penetration hole 32*a*.

The moveable blade 33 is configured to push one side 5*c* of a cut end portion (hereinafter, referred to as 'termination portion') 5*b*-side of the cut and separated wire 5 in a cutting direction (upward direction). An upper part of the other surface 33*b* of the moveable blade 33 is formed with a bending projection 34 having a substantially triangular shape. The bending projection 34 has a vertical surface 34*a* formed by extending the other surface 33*b* and an inclined surface 34*b* inclined downwards from a tip portion of the vertical surface 34*a* towards the fixed blade 32. The bending projection 34 is formed at an upper end of the moveable blade 33 and configures a bending part of a holding device configured to bend and hold the one side 5*c* of the termination portion 5*b*-side of the cut wire 5. The one side 5*c* of the termination portion 5*b*-side of the wire 5 indicates a position to which the tip portion of the bending projection 34 of the moveable blade 33 is contacted.

According to the reinforcing bar binding machine 1 having the above configuration, after the wire 5 is curled at the guide part 6 and is then wound around the reinforcing bars 7, when the wire cutting mechanism 31 operates to move the moveable blade 33 upwards, the tip portion of the bending projection 34 is engaged in the vicinity of the termination portion 5*b* of the wire 5 to push up and bend the wire 5 before the cutting and then the wire 5 is cut by the upper end edge of the one surface 33*a*.

The moveable blade 33 is stopped at the cutting position after the cutting. The one side 5*c* of the termination portion 5*b*-side of the wire 5 is bent by the tip portion of the bending projection 34, is hooked at the tip portion of the bending projection 34 and is held with the wire 5 being engaged with the inclined surface 34*b* from the termination portion 5*b* to the one side 5*c* of the termination portion 5*b*. A start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. The moveable blade 33 is configured to also serve as the bending member just by providing the bending projection 34, so that a separate member for bending is not required. Also, since it is possible to bend and hold the termination portion 5*b* of the wire 5 by the series of the wire cutting operations, a special operation is not required.

After binding the reinforcing bars, the moveable blade 33 is returned to the original position before the cutting. Therefore, the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

Figure 6:
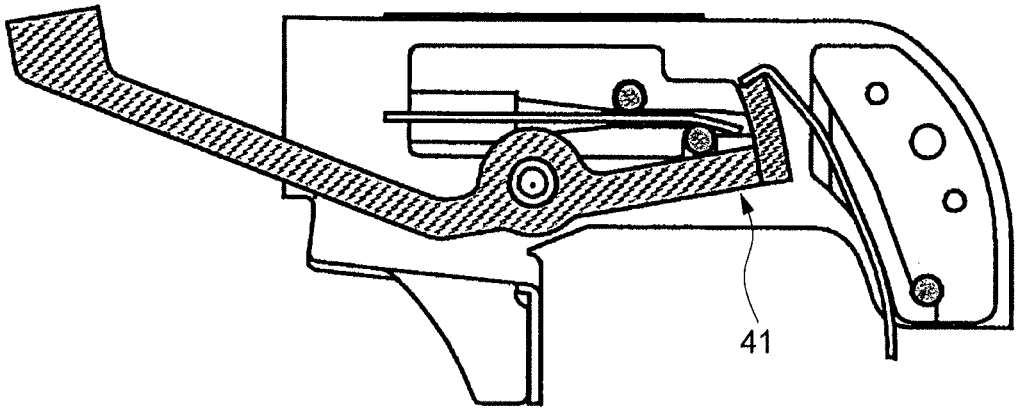
FIG. 6 is a side view illustrating a second illustrative embodiment of the internal configuration of the guide part of the reinforcing bar binding machine.

In the first illustrative embodiment, the vertical sliding-type wire cutting mechanism 31 has been described. However, as shown in FIG. 6, it is possible to accomplish the same operational effects by a swinging-type wire cutting mechanism 41 as shown in FIG. 6, too.

Figure 7:
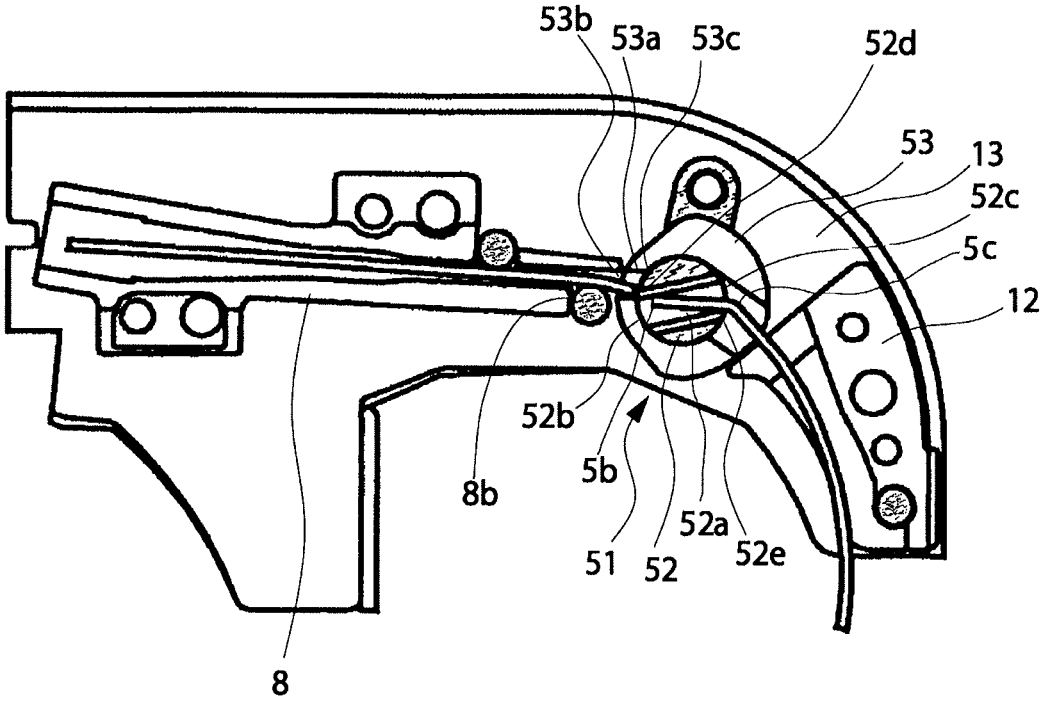
FIG. 7 is a side view illustrating a third illustrative embodiment of the internal configuration of the guide part of the reinforcing bar binding machine.

A third illustrative embodiment of the guide part 6 is described. As shown in FIG. 7, when a feeding length of the wire 5 reaches a predetermined amount, the wire cutting mechanism 51 cuts the wire 5. That is, the wire cutting mechanism 51 is a rotary cutter having the circular shaft-shaped moveable blade 52 provided to be rotatable, the fixed blade 53 fixed to the guide frame 13 and configured to rotatably accommodate the circular shaft-shaped moveable blade 52 and the driving lever 16 configured to rotate the moveable blade 52.

The circular shaft-shaped moveable blade 52 is formed with the wire penetration hole 52*a* penetrated in the feeding direction of the wire 5. One end of the wire penetration hole 52*a* opens towards the tip portion 8*b* of the guide pipe 8, and the other end opens towards the curl guide 12. The one end-side opening of the wire penetration hole 52*a* is the wire entry opening 52*b*, and the other end-side opening of the wire penetration hole 52*a* is the wire exit opening 52*c*. Also, the fixed blade 53 is formed with the wire insertion penetration hole 53*a* penetrated in the feeding direction of the wire 5. One end of the wire insertion penetration hole 53*a* opens towards the tip portion 8*b* of the guide pipe 8, and the other end of the wire insertion penetration hole 53*a* opens towards the wire entry opening 52*b* of the wire penetration hole 52*a* of the moveable blade 52. The one end-side opening of the wire insertion penetration hole 53*a* is the wire entry opening 53*b*, and the other end-side opening of the wire insertion penetration hole 53*a* is the wire discharge opening 53*c*.

The wire cutting mechanism 51 is configured to rotate the moveable blade 52 in a counterclockwise direction by the driving lever 16, to enable a surface of the wire entry opening 52*b*-side of the moveable blade 52 to slide downwards along a surface of the wire discharge opening 53*c*-side of the fixed blade 53, and to enable an upper end edge 52*d* of the wire entry opening 52*b* of the moveable blade 52 to cut the wire 5 having passed through the wire penetration hole 52*a*.

The moveable blade 52 is configured to cut the wire 5, and to push and bend one side 5*c* of a cut end portion (hereinafter, referred to as 'termination portion') 5*b*-side of the cut and separated wire 5 in a counter-cutting direction (upward direction) by a lower end edge 52*e* of the wire exit opening 52*c* of the wire penetration hole 52*a*. Therefore, according to the reinforcing bar binding machine 1, the lower end edge 52*e* of the wire exit opening 52*c* of the wire penetration hole 52*a* of the moveable blade 52 is configured to bend and hold the one side 5*c* of the termination portion 5*b*-side after cutting the wire 5. The one side 5*c* of the termination portion 5*b*-side of the wire 5 indicates a position to which the lower end edge 52*e* of the moveable blade 52 is contacted.

According to the reinforcing bar binding machine 1 having the above configuration, after the wire 5 is curled at the guide part 6 and is then wound around the reinforcing bars 7, the wire cutting mechanism 31 operates to rotate the moveable blade 52, so that the upper end edge 52*d* of the wire entry opening 52*b* of the wire penetration hole 52*a* of the moveable blade 52 cuts the wire 5. Simultaneously with the cutting of the wire 5, the lower end edge 52*e* of the wire exit opening 52*c* of the wire penetration hole 52*a* of the moveable blade 52 pushes and bends the one side 5*c* of the termination portion 5*b*-side of the cut wire 5 in the cutting direction (upward direction). The moveable blade 52 is stopped at the cutting position after the cutting. The one side 5*c* of the termination portion 5*b*-side of the wire 5 is bent by the lower end edge 52*e* of the wire exit opening 52*c* of the wire penetration hole 52*a* of the moveable blade 52, and is hooked and held at the lower end edge 52*e*.

The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. Upon the cutting of the wire 5, the termination portion 5*b* of the wire 5 is located in the wire penetration hole 52*a* of the moveable blade 52 and the wire is bent with the lower end edge 52*e* of the moveable blade 52. Therefore, a bending length corresponding to the longitudinal direction of the wire penetration hole 52*a* is secured, so that the wire 5 can be securely hooked. Also, since it is possible to bend and hold the termination portion 5*b* of the wire 5 by the series of the wire cutting operations, a special operation is not required.

After binding the reinforcing bars, the moveable blade 52 is returned to the original position before the cutting. Therefore, the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

Figure 8:
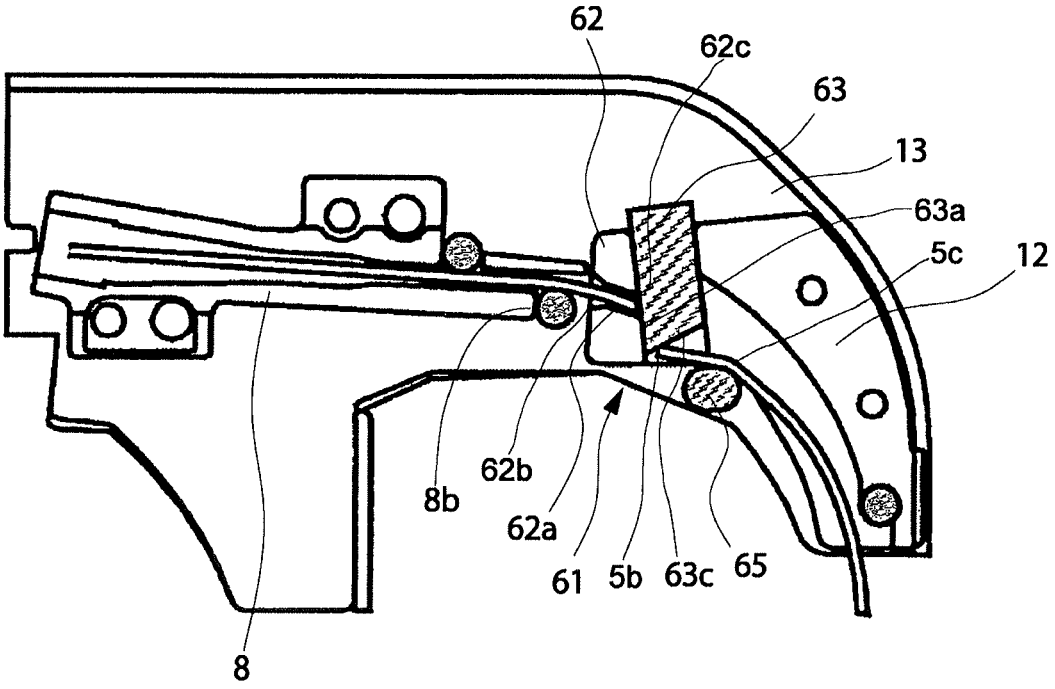
FIG. 8 is a side view illustrating a fourth illustrative embodiment of the internal configuration of the guide part of the reinforcing bar binding machine.

A fourth illustrative embodiment of the guide part 6 is described. As shown in FIG. 8, when a feeding length of the wire 5 reaches a predetermined amount, a wire cutting mechanism 61 cuts the wire 5. That is, the wire cutting mechanism 61 is a slide cutter having a fixed blade 62 fixed to the guide frame 13, a moveable blade 63 configured to slide to the fixed blade 62 and to cut the wire 5, and the driving lever 16 configured to move the moveable blade 63.

The fixed blade 62 is formed with a wire penetration hole 62*a* penetrated in the feeding direction of the wire 5. One end of the wire penetration hole 62*a* opens towards the tip portion 8*b* of the guide pipe 8, and the other end opens towards the curl guide 12. The one end-side opening of the wire penetration hole 62*a* is a wire entry opening 62*b*, and the other end-side opening of the wire penetration hole 62*a* is a wire exit opening 62*c*.

The wire cutting mechanism 61 is configured to move downwards (from an outer side towards an inner side of a curve of the wire) the moveable blade 63 by the driving lever 16, to enable one surface 63*a* of the moveable blade 63 to slide downwards along a surface of the wire exit opening 62*c*-side of the wire penetration hole 62*a* of the fixed blade 62, and to enable a lower end edge of the one surface 63*a* of the moveable blade 63 to cut the wire 5 having passed through the wire penetration hole 62*a*.

The moveable blade 63 is configured to push the cut end portion (hereinafter, referred to as 'termination portion') 5*b*-side of the cut and separated wire 5 in a cutting direction (downward direction) by a lower end portion 63*c*. The guide frame 13 is provided with a guide member 65 serving as a contact part configured to contact and bend one side 5*c* of the termination portion 5*b*-side of the wire 5 pushed by the moveable blade 63. The one side 5*c* of the termination portion 5*b*-side of the wire 5 pushed by the lower end portion 63*c* of the moveable blade 63 is contacted to the guide member 65 and is thus bent. Therefore, the reinforcing bar binding machine 1 is configured to sandwich and hold the one side 5*c* of the termination portion 5*b*-side of the cut wire 5 by the lower end portion 63*c* of the moveable blade 63 and the guide member 65. The one side 5*c* of the termination portion 5*b*-side of the wire 5 indicates a position to which the guide member 65 is contacted.

According to the reinforcing bar binding machine 1 having the above configuration, after the wire 5 is curled at the guide part 6 and is then wound around the reinforcing bars 7, when the wire cutting mechanism 61 operates to move the moveable blade 63 downwards to cut the wire, the lower end portion 63*c* pushes the termination portion 5*b* of the cut wire 5 in the cutting direction (downward direction) and the one side 5*c* of the termination portion 5*b*-side of the wire 5 is contacted to the guide member 65 and is thus bent.

The moveable blade 63 is stopped at the cutting position after the cutting. The one side 5*c* of the termination portion 5*b*-side of the wire 5 is sandwiched by the lower end portion 63*c* of the moveable blade 63 and the guide member 65. Thereby, the one side 5*c* of the termination portion 5*b*-side of the wire 5 is held by the lower end portion 63*c* of the moveable blade 63 and the guide member 65. The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. It is possible to bend the wire 5 and to hold the termination portion 5*b* of the wire by using the operation of cutting the wire 5 by the moveable blade 63 and the guide member 65.

After binding the reinforcing bars, the moveable blade 63 is returned to the original position before the cutting. Therefore, the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

Figure 9:
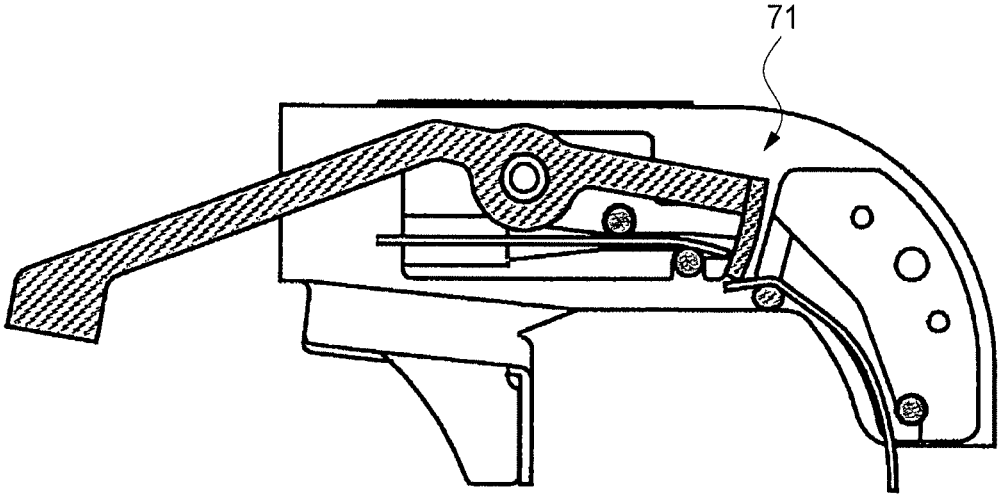
FIG. 9 is a side view illustrating a fifth illustrative embodiment of the internal configuration of the guide part of the reinforcing bar binding machine.

In the fourth illustrative embodiment, the vertical sliding-type wire cutting mechanism 61 has been described. However, as shown in FIG. 9, it is possible to accomplish the same operational effects by a swinging-type wire cutting mechanism 71, too.

Figure 10A:
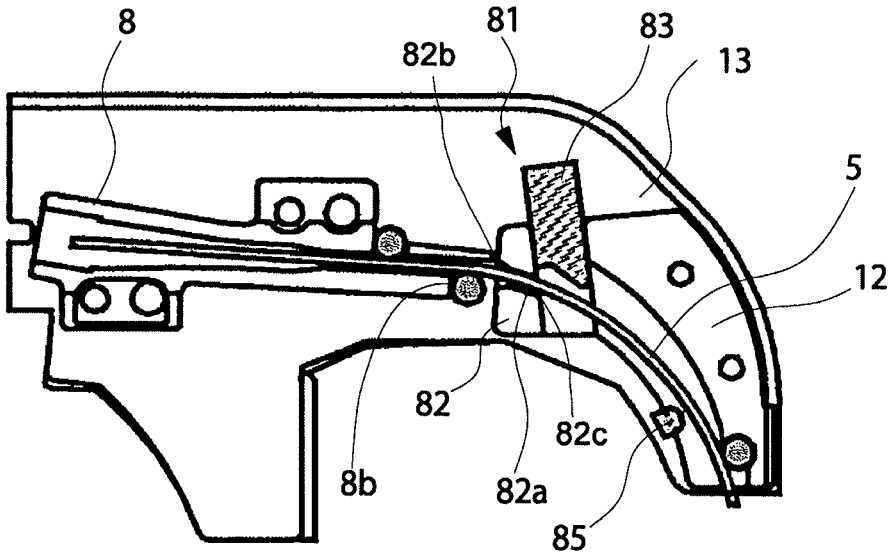
FIGS. 10A and 10B are side views illustrating a sixth illustrative embodiment of the internal configuration of the guide part of the reinforcing bar binding machine.

A sixth illustrative embodiment of the guide part 6 is described. As shown in FIG. 10, when a feeding length of the wire 5 reaches a predetermined amount, a wire cutting mechanism 81 cuts the wire 5. That is, the wire cutting mechanism 81 is a slide cutter having a fixed blade 82 fixed to the guide frame 13, a moveable blade 83 configured to slide to the fixed blade 82 and to cut the wire 5, and the driving lever 16 configured to move the moveable blade 83.

The fixed blade 82 is formed with a wire penetration hole 82*a* penetrated in the feeding direction of the wire 5. One end of the wire penetration hole 82*a* opens towards the tip portion 8*b* of the guide pipe 8, and the other end opens towards the curl guide 12. The one end-side opening of the wire penetration hole 82*a* is a wire entry opening 82*b*, and the other end-side opening of the wire penetration hole 82*a* is a wire exit opening 82*c*.

The wire cutting mechanism 81 is configured to move downwards (from an outer side towards an inner side of a curve of the wire) the moveable blade 83 by the driving lever 16, to enable one surface 83*a* of the moveable blade 83 to slide downwards along a surface of the wire exit opening 82*c*-side of the wire penetration hole 82*a* of the fixed blade 82, and to enable a lower end edge of the one surface 83*a* of the moveable blade 83 to cut the wire 5 having passed through the wire penetration hole 82*a*.

The moveable blade 83 is configured to push one side 5*c* of the cut end portion (hereinafter, referred to as 'termination portion') 5*b*-side of the cut and separated wire 5 in a cutting direction (downward direction) by a lower end portion 83*c*. A lower part of the other surface 83*b* of the moveable blade 83 is formed with a bending projection 84 having a substantially triangular shape. The bending projection 84 has a vertical surface 84*a* formed by extending the other surface 83*b* and an inclined surface 84*b* inclined upwards from a tip portion of the vertical surface 84*a* towards the fixed blade 82.

The guide frame 13 is provided with a guide member 85 of a contact part, which is configured to be contacted and bent to one side 5*c* of the termination portion 5*b*-side of the wire 5 pushed and bent by the bending projection 84 of the moveable blade 83. Therefore, the reinforcing bar binding machine 1 is configured to hold the one side 5*c* of the bent termination portion 5*b*-side after the wire 5 is cut, by the guide member 85. The bending projection 84 is formed at the lower end portion 83*c* of the moveable blade 83 and configures a bending part of a holding device configured to hold the one side 5*c* of the termination portion 5*b*-side of the wire 5. The one side 5*c* of the termination portion 5*b*-side of the wire 5 indicates a position to which the tip portion of the bending projection 84 of the moveable blade 83 is contacted.

Figure 10B:
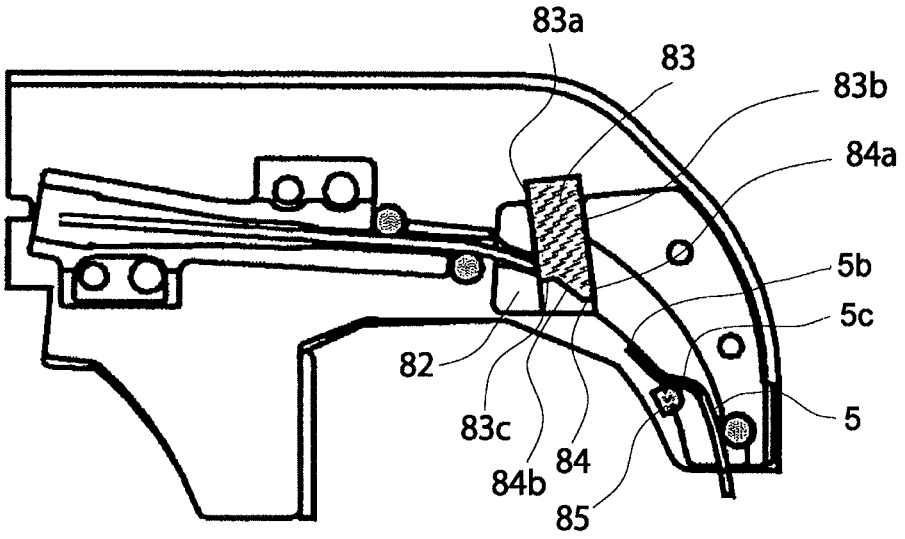

According to the reinforcing bar binding machine 1 having the above configuration, after the wire 5 is curled at the guide part 6 and is then wound around the reinforcing bars 7, when the wire cutting mechanism 81 operates to move the moveable blade 83 downwards, as shown in FIG. 10B, the tip portion of the bending projection 84 is engaged with the one side 5*c* of the termination portion 5*b*-side of the wire 5 to push down and bend the wire 5 before the cutting and then the wire 5 is cut by the lower end edge of the one surface 83*a*.

The moveable blade 83 is returned to its original position and is stopped immediately after the cutting. Since the one side 5*c* of the termination portion 5*b*-side of the wire 5 is bent, it is hooked and held at the guide member 85. The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. Also, since the moveable blade 83 does not directly hold the termination portion 5*b* of the wire 5, the load for holding is not applied to the moveable blade 83, so that the durability is improved.

After binding the reinforcing bars, since the one side 5*c* of the termination portion 5*b*-side of the wire is simply hooked and held at the guide member 85, it is possible to smoothly and simply pull out both ends 5*a*, 5*b* of the cut and twisted wire 5 from the binding machine main body 2 without any deformation.

Figure 11:
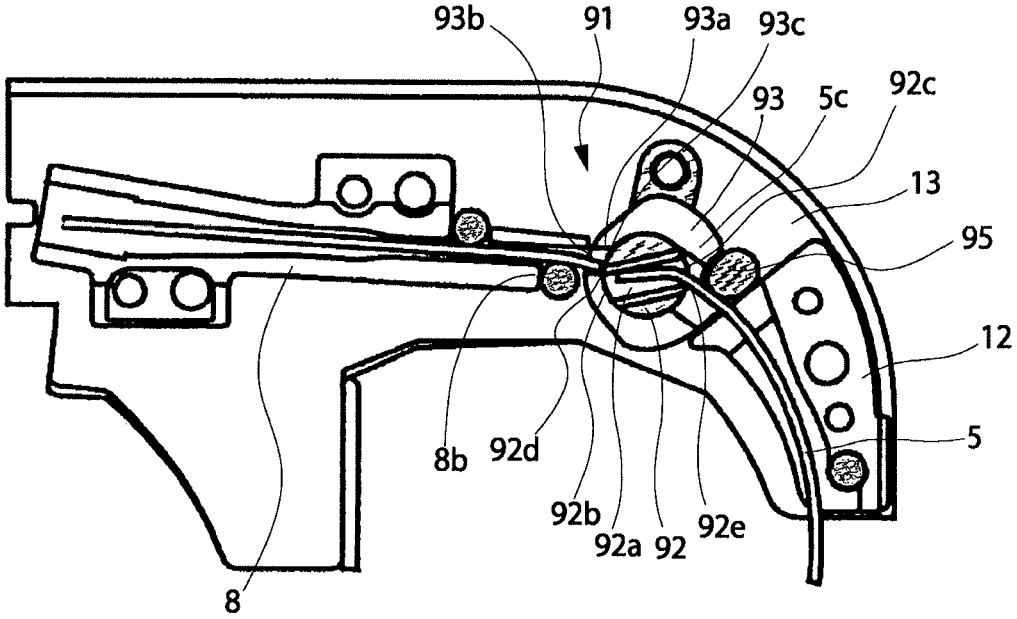
FIG. 11 is a side view illustrating a seventh illustrative embodiment of the internal configuration of the guide part of the reinforcing bar binding machine.

A seventh illustrative embodiment of the guide part 6 is described. As shown in FIG. 11, when a feeding length of the wire 5 reaches a predetermined amount, a wire cutting mechanism 91 cuts the wire 5. That is, the wire cutting mechanism 91 is a rotary cutter having a circular shaft-shaped moveable blade 92 provided to be rotatable, a fixed blade 93 fixed to the guide frame 13 and configured to rotatably accommodate the circular shaft-shaped moveable blade 92 and the driving lever 16 configured to rotate the moveable blade 92.

The circular shaft-shaped moveable blade 92 is formed with a wire penetration hole 92*a* penetrated in the feeding direction of the wire 5. One end of the wire penetration hole 92*a* opens towards the tip portion 8*b* of the guide pipe 8, and the other end opens towards the curl guide 12. The one end-side opening of the wire penetration hole 92*a* is a wire entry opening 92*b*, and the other end-side opening of the wire penetration hole 92*a* is a wire exit opening 92*c*. Also, the fixed blade 93 is formed with a wire insertion penetration hole 93*a* penetrated in the feeding direction of the wire 5. One end of the wire insertion penetration hole 93*a* opens towards the guide pipe 8, and the other end of the wire insertion penetration hole 93*a* opens towards the wire entry opening 92*b* of the wire penetration hole 92*a* of the moveable blade 92. The one end-side opening of the wire insertion penetration hole 93*a* is a wire entry opening 93*b*, and the other end-side opening of the wire insertion penetration hole 93*a* is a wire discharge opening 93*c*.

The wire cutting mechanism 91 is configured to rotate the moveable blade 92 in a counterclockwise direction by the driving lever 16, to enable a surface of the wire entry opening 92*b*-side of the moveable blade 92 to slide downwards along a surface of the wire discharge opening 93*c*-side of the fixed blade 93, and to enable an upper end edge 92*d* of the wire entry opening 92*b* of the moveable blade 92 to cut the wire 5 having passed through the wire penetration hole 92*a*.

The moveable blade 92 is configured to cut the wire 5, and to push and bend one side 5*c* of a cut end portion (hereinafter, referred to as 'termination portion') 5*b*-side of the cut and separated wire 5 in a counter-cutting direction (upward direction) and to form a bent part by a lower end edge 92*e* of the wire exit opening 92*c* of the wire penetration hole 92*a*. The guide frame 13 is provided with a guide member 95 serving as a contact part configured to contact the one side 5*c* of the termination portion 5*b*-side of the wire 5 pushed with the moveable blade 92. Therefore, according to the reinforcing bar binding machine 1, the one side 5*c* of the termination portion 5*b*-side serving as the bent part after the wire 5 is cut is sandwiched and held by the lower end edge 92*e* of the wire penetration hole 92*a* of the moveable blade 92 and the guide member 95. The one side 5*c* of the termination portion 5*b*-side of the wire 5 indicates a position to which the lower end edge 92*e* of the wire penetration hole 92*a* of the moveable blade 92 is contacted.

According to the reinforcing bar binding machine 1 having the above configuration, after the wire 5 is curled at the guide part 6 and is then wound around the reinforcing bars 7, the wire cutting mechanism 91 operates to rotate the moveable blade 92, so that the upper end edge 92*d* of the wire entry opening 92*b* of the wire penetration hole 92*a* of the moveable blade 92 cuts the wire 5. Simultaneously with the cutting, the lower end edge 92*e* of the wire exit opening 92*c* of the wire penetration hole 92*a* of the moveable blade 92 pushes the one side 5*c* of the termination portion 5*b*-side of the cut wire 5 in the cutting direction (upward direction), so that the one side 5*c* of the termination portion 5*b*-side of the wire 5 is sandwiched by the lower end edge 92*e* of the wire penetration hole 92*a* of the moveable blade 92 and the guide member 95. The moveable blade 92 is stopped at the cutting position after the cutting. Thereby, the one side 5*c* of the termination portion 5*b*-side of the wire 5 is held by the lower end edge 92*e* of the wire exit opening 92*c* of the moveable blade 92 and the guide member 95

The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. Since the termination portion 5*b* of the wire 5 is fitted with the moveable edge 92 and the guide member 95 by using the operation of the moveable blade 92 upon the cutting of the wire 5, it can be securely held.

After binding the reinforcing bars, the moveable blade 92 is returned to the original position before the cutting. Therefore, the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

Figure 12:
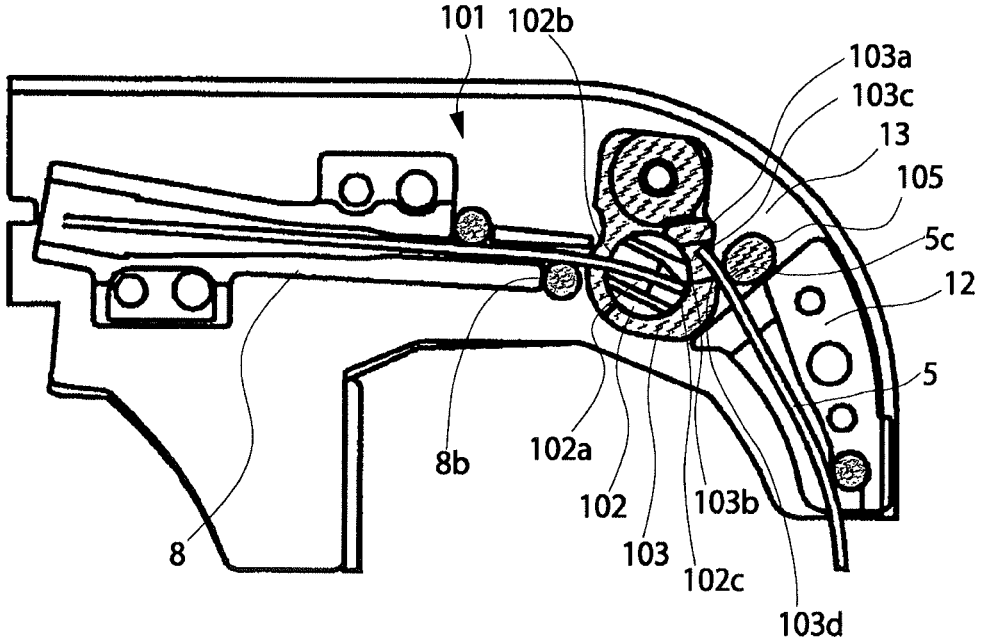
FIG. 12 is a side view illustrating an eighth illustrative embodiment of the internal configuration of the guide part of the reinforcing bar binding machine.

An eighth illustrative embodiment of the guide part 6 is described. As shown in FIG. 12, when a feeding length of the wire 5 reaches a predetermined amount, a wire cutting mechanism 101 cuts the wire 5. That is, the wire cutting mechanism 101 is a rotary cutter having a circular shaft-shaped fixed blade 102 fixed to the guide frame 13, a moveable blade 103 provided to be rotatable around the fixed blade 102, and the driving lever 16 configured to rotate the moveable blade 103.

The circular shaft-shaped fixed blade 102 is formed with a wire penetration hole 102*a* penetrated in the feeding direction of the wire 5. One end of the wire penetration hole 102*a* opens towards the tip portion 8*b* of the guide pipe 8, and the other end opens towards the curl guide 12. The one end-side opening of the wire penetration hole 102*a* is a wire entry opening 102*b*, and the other end-side opening of the wire penetration hole 102*a* is a wire exit opening 102*c*. Also, the moveable blade 103 is formed with a wire insertion penetration hole 103*a* penetrated in the feeding direction of the wire 5. One end of the wire insertion penetration hole 103*a* opens towards the wire exit opening 102*c* of the wire penetration hole 102*a* of the fixed blade 102, and the other end opens towards the curl guide 12. The one end-side opening of the wire insertion penetration hole 103*a* of the moveable blade 103 is a wire entry opening 103*b*, and the other end-side opening of the wire insertion penetration hole 103*a* is a wire discharge opening 103*c*.

The wire cutting mechanism 101 is configured to rotate the moveable blade 103 in a counterclockwise direction by the driving lever 16, to enable a surface of the wire entry opening 103*b*-side of the moveable blade 103 to slide upwards along a surface of the wire exit opening 102*c*-side of the fixed blade 102, and to enable a lower end edge of the wire entry opening 103*b* of the moveable blade 103 to cut the wire 5 having passed through the wire penetration hole 102*a*.

The moveable blade 103 is configured to cut the wire 5, and to push one side 5*c* of a cut end portion (hereinafter, referred to as 'termination portion') 5*b*-side of the cut and separated wire 5 in a cutting direction (upward direction) by a lower end edge 103*d* of the wire discharge opening 103*c* of the wire insertion penetration hole 103*a*. The guide frame 13 is provided with a guide member 105 configured to contact the one side 5*c* of the termination portion 5*b*-side of the wire 5 pushed with the moveable blade 103. Therefore, according to the reinforcing bar binding machine 1, after the wire 5 is cut, the one side 5*c* of the termination portion 5*b*-side is held by the lower end edge 103*d* of the wire insertion penetration hole 103*a* of the moveable blade 103 and the guide member 105. The one side 5*c* of the termination portion 5*b*-side of the wire 5 indicates a position to which the lower end edge 92*e* of the wire insertion penetration hole 103*a* of the moveable blade 103 is contacted.

According to the reinforcing bar binding machine 1 having the above configuration, after the wire 5 is curled at the guide part 6 and is then wound around the reinforcing bars 7, the wire cutting mechanism 31 operates to rotate the moveable blade 103 upwards, so that the lower end edge of the wire entry opening 103*b* of the moveable blade 103 cuts the wire 5. Simultaneously with the cutting, the lower end edge 103*d* of the wire discharge opening 103*e* of the moveable blade 103 pushes up the one side 5*c* of the termination portion 5*b*-side of the cut wire 5 in the cutting direction (upward direction), so that the one side 5*c* of the termination portion 5*b* of the wire 5 is sandwiched by the lower end edge 103*d* of the wire discharge opening 103*c* of the moveable blade 103 and the guide member 105. The moveable blade 103 is stopped at the cutting position after the cutting. Thereby, the one side 5*c* of the termination portion 5*b*-side of the wire 5 is held by the moveable blade 103 and the guide member 105.

The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. Since the termination portion 5*b* of the wire 5 is fitted with the moveable edge 92 and the guide member 105 by using the operation of the moveable blade 103 upon the cutting of the wire 5, it can be securely held. In the fourth to eights illustrative embodiments, the termination portion 5*b* of the wire 5 is held using the guide member serving as the contact part. Since the guide member can be arranged using a space of the guide frame 13 and may be made to be smaller that the wire cutting mechanism and the other members, the arrangement can be easily adjusted and the maintenance ability is also high.

After binding the reinforcing bars, the moveable blade 103 is returned to the original position before the cutting. Therefore, the holding state of the one side 5*c* of the termination portion 5*b* of the wire 5 is released, so that it is possible to smoothly and simply pull out both ends 5*a*, 5*b* of the cut and twisted wire 5 from the binding machine main body 2 without any deformation.

In the eighth illustrative embodiment, the wire cutting mechanism 101 has the circular shaft-shaped fixed blade 102 and the moveable blade 103 provided to be rotatable around the fixed blade 102. However, a wire cutting mechanism is also possible which includes an internal moveable blade 102 and an external moveable blade 103 configured to rotatably accommodate the internal moveable blade 102 and is configured to rotate the internal moveable blade 102 and external moveable blade 103 to cut the wire 5.

Figure 13A:
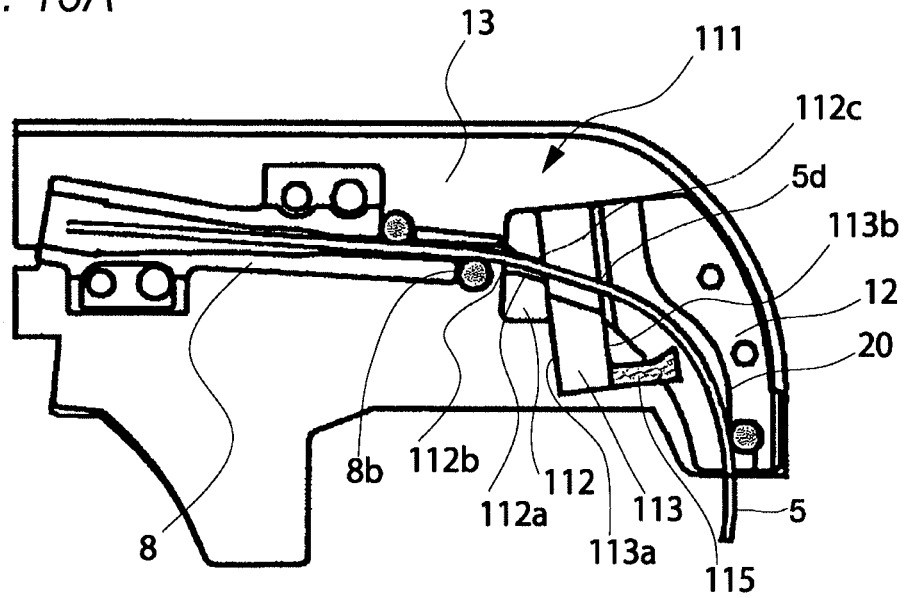
FIGS. 13A and 13B are side views illustrating a ninth illustrative embodiment of the internal configuration of the guide part of the reinforcing bar binding machine.
Figure 13B:
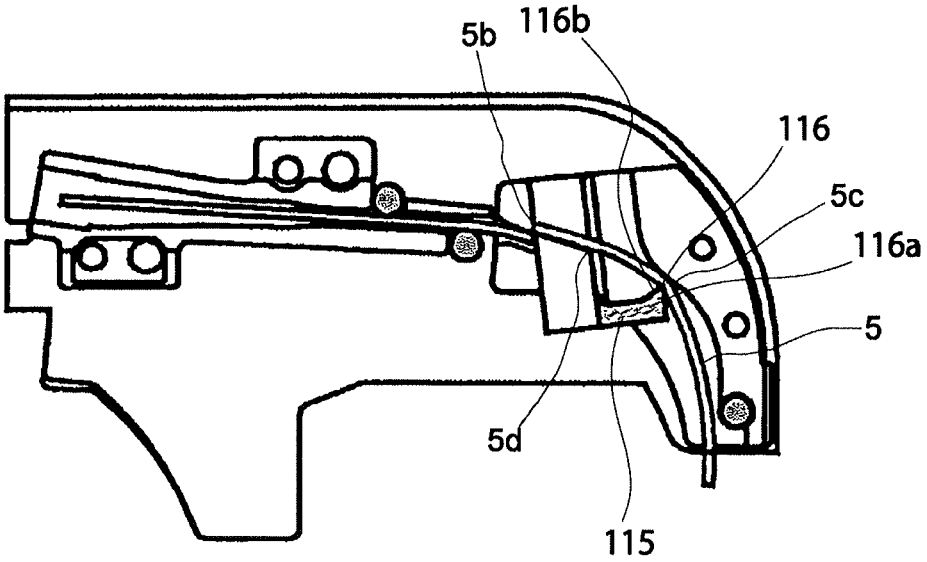

A ninth illustrative embodiment of the guide part 6 is described. As shown in FIG. 13, when a feeding length of the wire 5 reaches a predetermined amount, a wire cutting mechanism 111 cuts the wire 5. That is, the wire cutting mechanism 111 is a slide cutter having a fixed blade 112 fixed to the guide frame 13, a moveable blade 113 configured to slid to the fixed blade 112 and to cut the wire 5, and the driving lever 16 configured to move the moveable blade 113.

The fixed blade 112 is formed with a wire penetration hole 112*a* penetrated in the feeding direction of the wire 5. One end of the wire penetration hole 112*a* opens towards the tip portion 8*b* of the guide pipe 8, and the other end opens towards the curl guide 12. The one end-side opening of the wire penetration hole 112*a* is a wire entry opening 112*b*, and the other end-side opening of the wire penetration hole 112*a* is a wire exit opening 112*c*.

The wire cutting mechanism 111 is configured to move upwards (from an inner side towards an outer side of a curve of the wire) the moveable blade 113 by the driving lever 16, to enable one surface 113*a* of the moveable blade 113 to slide upwards along a surface of the wire exit opening 112*c*-side of the wire penetration hole 112*a* of the fixed blade 112, and to enable an upper end edge of the one surface 113*a* of the moveable blade 113 to cut the wire 5 having passed through the wire penetration hole 112*a*.

The moveable blade 113 is provided with a pressing member 115 configured to push one side 5*c* of the termination portion 5*b*-side of the cut wire 5 in a cutting direction (upward direction). The pressing member 115 has an arm shape and is provided at a lower part of the other surface 113*b* of the moveable blade 113. A tip portion of the pressing member 115 is formed with a pressing projection 116 having a substantially triangular shape. The pressing projection 116 has a vertical surface 116*a* formed by extending the tip surface of the pressing member 115 and an inclined surface 116*b* inclined downwards from a tip portion of the vertical surface 116*a* towards the other surface 113*b*-side. The pressing projection 116 configures a pressing part of a holding device configured to press the one side 5*c* of the termination portion 5*b*-side of the cut wire 5 to a side surface (guide recess 20) of the wire guide passage (curl guide 12). The one side 5*c* of the termination portion 5*b*-side of the wire 5 indicates a position to which the tip portion of the pressing projection 116 of the moveable blade 113 is contacted.

According to the reinforcing bar binding machine 1 having the above configuration, after the wire 5 is curled at the guide part 6 and is then wound around the reinforcing bars 7, the wire cutting mechanism 111 operates to move the moveable blade 113 upwards, so that an upper edge of the other surface 113*b* of the moveable blade 113 is engaged with a vicinity 5*d* of the termination portion 5*b* of the wire 5 and pushes up and bends the wire 5 before the cutting, and then the wire 5 is cut by the upper end edge of the one surface 113*a* of the moveable blade 113.

After the cutting, the tip portion of the pressing projection 116 is engaged with the one side 5*c* of the termination portion 5*b*-side of the wire 5 and presses the wire 5 to the side surface (guide recess 20) of the wire guide passage (curl guide 12). The moveable blade 113 is stopped at the cutting position after the cutting. The vicinity 5*d* of the termination portion of the wire 5 is bent by the upper edge of the other surface 113*b* of the moveable blade 113. Since the wire guide passage (curl guide 12) is narrowed by the side surface (guide recess 20) and the tip portion of the pressing projection 116, the bent vicinity 5*d* of the termination portion of the wire 5 is hooked and held at the tip portion of the pressing projection 116. The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. The moveable blade 113 may be simply provided with the pressing member 115 and it is possible to press and hold the termination portion 5*b* of the wire 5 at the curl guide 12 with the pressing member 115 by the series of the wire cutting operations.

After binding the reinforcing bars, when the trigger is released, the pressing member 115 is returned to the original position together with the moveable blade 113. Therefore, the holding state of the vicinity 5*d* of the termination portion of the wire 5 is released, so that it is possible to smoothly and simply pull out both ends 5*a*, 5*b* of the cut and twisted wire 5 from the binding machine main body 2 without any deformation. Also, the pressing member 115 is configured to narrow the space between the pressing projection 116 and the guide recess 20. Thereby, the pressing member is difficult to pass to the vicinity 5*d* of the termination portion of the wire 5. However, the one side 5*c* of the termination portion 5*b*-side of the cut wire 5 may be pressed and held at the side surface (guide recess 20) of the wire guide passage (curl guide 12) by the pressing member 115.

Figure 14A:
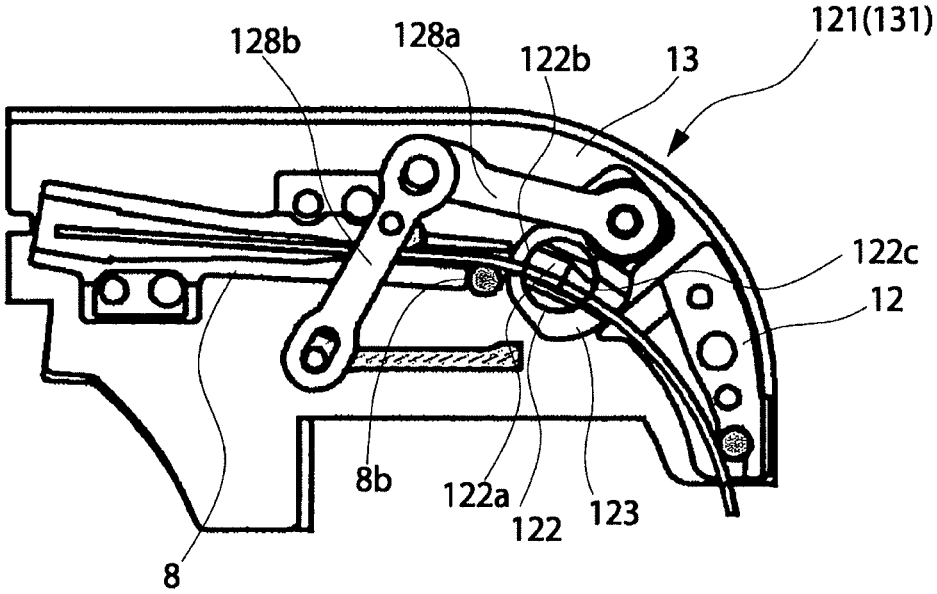
FIGS. 14A and 14B are side views illustrating tenth and eleventh illustrative embodiments of the internal configuration of the guide part of the reinforcing bar binding machine.
Figure 14B:
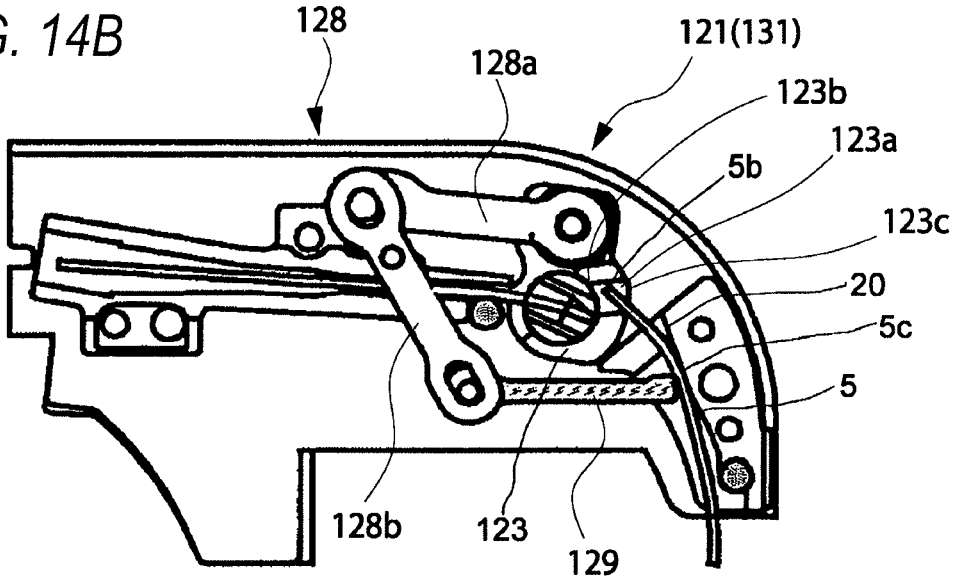

A tenth illustrative embodiment of the guide part 6 is described. As shown in FIG. 14, when a feeding length of the wire 5 reaches a predetermined amount, a wire cutting mechanism 121 cuts the wire 5. That is, the wire cutting mechanism 121 is a rotary cutter having a circular shaft-shaped fixed blade 122 fixed to the guide frame 13, a moveable blade 123 provided to be rotatable around the fixed blade 122, and the driving lever 16 configured to move the moveable blade 123.

The circular shaft-shaped fixed blade 122 is formed with a wire penetration hole 122*a* penetrated in the feeding direction of the wire 5. One end of the wire penetration hole 122*a* opens towards the tip portion 8*b* of the guide pipe 8, and the other end opens towards the curl guide 12. The one end-side opening of the wire penetration hole 122*a* is a wire entry opening 122*b*, and the other end-side opening of the wire penetration hole 122*a* is a wire exit opening 122*c*. Also, the moveable blade 123 is formed with a wire insertion penetration hole 123*a* penetrated in the feeding direction of the wire 5. One end of the wire insertion penetration hole 123*a* opens towards the wire exit opening 122*c* of the wire penetration hole 122*a* of the fixed blade 122, and the other end opens towards the curl guide 12. The one end-side opening of the wire insertion penetration hole 123*a* is a wire entry opening 123*b*, and the other end-side opening of the wire insertion penetration hole 123*a* is a wire discharge opening 123*c*.

The wire cutting mechanism 121 is configured to move the moveable blade 123 in the counterclockwise direction by the driving lever 16, to enable a surface of the wire entry opening 123*b*-side of the moveable blade 123 to slide upwards along a surface of the wire exit opening 122*c*-side of the fixed blade 122, and to enable a lower end edge of the wire entry opening 123*b* of the moveable blade 123 to cut the wire 5 having passed through the wire penetration hole 122*a*.

The moveable blade 123 is linked with a holding shaft 129 serving as a holding member through a link mechanism 128. The link mechanism has a first link member 128*a* and a second link member 128*b*. The second link member 128*b* is rotatably attached to the guide frame 13. The first link member 128*a* is rotatably attached to the moveable blade 123 at one side and is rotatably attached to an upper part of the second link member 128*b* at the other side. The holding shaft 129 is axially slidably attached to the guide frame 13 and has a rear end rotatably coupled to the second link member 128*b* and a tip to contact the one side 5*c* of the termination portion 5*b*-side of the wire 5.

The moveable blade 123 is configured to cut the wire, and the tip portion of the holding shaft 129 is configured to press the one side 5*c* of the termination portion 5*b*-side of the cut wire 5 to the side surface (guide recess 20) of the wire guide passage (curl guide 12) through the link mechanism 128. Therefore, the reinforcing bar binding machine 1 is configured to hold the one side 5*c* of the termination portion 5*b*-side of the cut wire 5 by the tip portion of the holding shaft 129 and the side surface (guide recess 20) of the wire guide passage (curl guide 12). The one side 5*c* of the termination portion 5*b*-side of the wire 5 indicates a position to which the tip portion of the holding shaft 129 is contacted.

According to the reinforcing bar binding machine 1 having the above configuration, after the wire 5 is curled at the guide part 6 and is then wound around the reinforcing bars 7, the wire cutting mechanism 121 operates to rotate the moveable blade 123, so that the lower end edge of the wire entry opening 123*b* of the wire insertion penetration hole 123*a* cuts the wire. Simultaneously with the cutting, the tip portion of the holding shaft 129 presses the one side 5*c* of the termination portion 5*b*-side of the cut wire 5 to the side surface (guide recess 20) of the wire guide passage (curl guide 12) through the link mechanism 128 and sandwiches the one side 5*c* of the termination portion 5*b* of the wire 5. The moveable blade 123 is stopped at the cutting position after the cutting. Thereby, the one side 5*c* of the termination portion 5*b*-side of the wire 5 is held by the tip portion of the holding shaft 129 and the side surface (guide recess 20) of the wire guide passage (curl guide 12). Also, in the tenth illustrative embodiment, the holding member is configured as the shaft-shaped (arm-shaped) holding shaft. However, the other side of the link mechanism may be made to come close to the wire guide passage-side and a circular or elliptical holding member may be configured, for example.

The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. The moveable blade 123 may be simply provided with the link mechanism 128 and the holding shaft 129 and it is possible to press and hold the termination portion 5*b* of the wire 5 at the curl guide 12 with the holding shaft 129 by the series of the wire cutting operations. Also, it is possible to adjust the pressing force of the holding shaft 129 by a length of the link mechanism.

After binding the reinforcing bars, the moveable blade 123 is returned to the original position before the cutting. Therefore, the holding shaft 129 is separated from the wire 5 through the link mechanism 128 and the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

An eleventh illustrative embodiment of the guide part 6 is described. The eleventh illustrative embodiment is different from the tenth illustrative embodiment, as regards the wire cutting mechanism. Therefore, the eleventh illustrative embodiment is described with reference to FIG. 14. When a feeding length of the wire 5 reaches a predetermined amount, a wire cutting mechanism 131 cuts the wire 5. That is, the wire cutting mechanism 131 is a rotary cutter having a circular shaft-shaped moveable blade 122 provided to be rotatable, a fixed blade 123 fixed to the guide frame 13 and configured to rotatably accommodate the circular shaft-shaped moveable blade 122, and the driving lever 16 configured to move the moveable blade 122.

The circular shaft-shaped moveable blade 122 is formed with a wire penetration hole 122*a* penetrated in the feeding direction of the wire 5. One end of the wire penetration hole 122*a* opens towards the tip portion 8*b* of the guide pipe 8, and the other end opens towards the curl guide 12. The one end-side opening of the wire penetration hole 122*a* is a wire entry opening 122*b*, and the other end-side opening of the wire penetration hole 122*a* is a wire exit opening 122*c*. Also, the fixed blade 123 is formed with a wire insertion penetration hole 123*a* penetrated in the feeding direction of the wire 5. One end of the wire insertion penetration hole 123*a* opens towards the wire exit opening 122*c* of the moveable blade 122, and the other end opens towards the curl guide 12. The one end-side opening of the wire insertion penetration hole 123*a* of the moveable blade 53 is a wire entry opening 123*b*, and the other end-side opening of the wire insertion penetration hole 123*a* is a wire discharge opening 123*c*.

The wire cutting mechanism 131 is configured to rotate the moveable blade 122 in the counterclockwise direction by the driving lever 16, to enable a surface of the wire exit opening 122*c*-side of the moveable blade 122 to slide upwards along a surface of the wire entry opening 123*b*-side of the fixed blade 123, and to enable a lower end edge of the wire exit opening 122*c* of the moveable blade 122 to cut the wire 5 having passed through the wire penetration hole 122*a*.

The driving lever 16 is linked with a holding shaft 129 through a link mechanism 128. The link mechanism has a first link member 128*a* and a second link member 128*b*. The second link member 128*b* is rotatably attached to the guide frame 13. The first link member 128*a* is rotatably attached to the moveable blade 122 at one side and is rotatably attached to an upper part of the second link member 128*b* at the other side. The holding shaft 129 is axially slidably attached to the guide frame 13 and has a rear end rotatably coupled to the second link member 128*b* and a tip to contact the one side 5*c* of the termination portion 5*b*-side of the wire 5.

The moveable blade 122 is configured to cut the wire, and the tip portion of the holding shaft 129 is configured to press the one side 5*c* of the termination portion 5*b*-side of the cut wire 5 to the side surface (guide recess 20) of the wire guide passage (curl guide 12) through the link mechanism 128. Therefore, the reinforcing bar binding machine 1 is configured to hold the one side 5*c* of the termination portion 5*b*-side of the cut wire 5 by the tip portion of the holding shaft 129 and the side surface (guide recess 20) of the wire guide passage (curl guide 12). The one side 5*c* of the termination portion 5*b*-side of the wire 5 indicates a position to which the tip portion of the holding shaft 129 is contacted. Also, in the eleventh illustrative embodiment, the holding member is configured as the shaft-shaped (arm-shaped) holding shaft. However, the other side of the link mechanism may be made to come close to the wire guide passage-side and a circular or elliptical holding member may be configured, for example.

According to the reinforcing bar binding machine 1 having the above configuration, after the wire 5 is curled at the guide part 6 and is then wound around the reinforcing bars 7, when the wire cutting mechanism 131 operates to rotate the moveable blade 122 upwards to cut the wire, the tip portion of the holding shaft 129 presses the one side 5*c* of the termination portion 5*b*-side of the cut wire 5 to the side surface (guide recess 20) of the wire guide passage (curl guide 12) through the operation lever and the link mechanism 128 and sandwiches the one side 5*c* of the termination portion 5*b* of the wire 5. The moveable blade 122 is stopped at the cutting position after the cutting. Thereby, the one side 5*c* of the termination portion 5*b*-side of the wire 5 is held by the tip portion of the holding shaft 129 and the side surface (guide recess 20) of the wire guide passage (curl guide 12).

The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. The moveable blade 113 may be simply provided with the link mechanism 128 and the holding shaft 129 and it is possible to press and hold the termination portion 5*b* of the wire 5 at the curl guide 12 with the holding shaft 129 by the series of the wire cutting operations. Also, it is possible to adjust the pressing force of the holding shaft 129 by a length of the link mechanism.

After binding the reinforcing bars, the moveable blade 122 is returned to the original position before the cutting. Therefore, the holding shaft 129 is separated from the wire 5 through the link mechanism 128 and the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

Figure 15A:
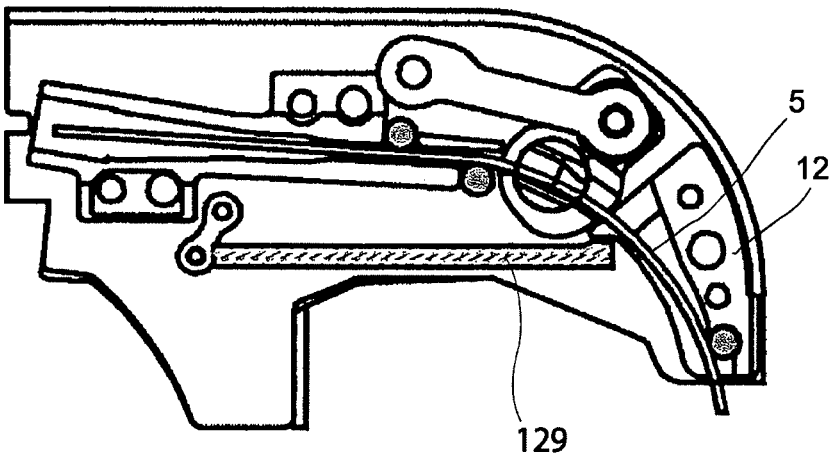
FIGS. 15A and 15B are side views illustrating a twelfth illustrative embodiment of the internal configuration of the guide part of the reinforcing bar binding machine.
Figure 15B:
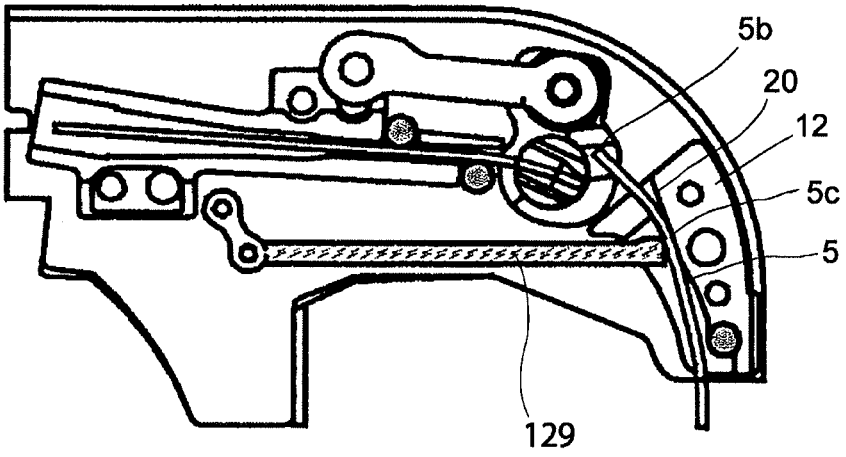

A twelfth illustrative embodiment of the guide part 6 is described. In the tenth and eleventh illustrative embodiments, the holding shaft 129 of the holding member is linked with the wire cutting mechanism 121; 131 through the link mechanism 128. However, as shown in FIG. 15, the holding shaft 129 of the holding member may be linked with the driving part of the binding machine main body 2 through another link mechanism. The wire cutting mechanism is a rotary cutter or a slide cutter as described above. When the wire is cut by the wire cutting mechanism, the tip portion of the holding shaft 129 presses the one side 5*c* of the cut end portion (hereinafter, referred to as 'termination portion') 5*b*-side of the cut and separated wire 5 to the side surface (guide recess 20) of the wire guide passage (curl guide 12) through another link mechanism by the driving part of the binding machine main body 2. Therefore, the reinforcing bar binding machine 1 is configured to hold the one side 5*c* of the termination portion 5*b*-side of the cut wire 5 by the tip portion of the holding shaft 129 and the side surface (guide recess 20) of the wire guide passage (curl guide 12). The one side 5*c* of the termination portion 5*b*-side of the wire 5 indicates a position to which the tip portion of the holding shaft 129 is contacted.

According to the reinforcing bar binding machine 1 having the above configuration, after the wire 5 is curled at the guide part 6 and is then wound around the reinforcing bars 7, when the wire cutting mechanism operates to cut the wire, the tip portion of the holding shaft 129 presses the one side 5*c* of the termination portion 5*b*-side of the cut wire 5 to the side surface (guide recess 20) of the wire guide passage (curl guide 12) through another link mechanism and sandwiches the one side 5*c* of the termination portion 5*b* of the wire 5. Thereby, the one side 5*c* of the termination portion 5*b*-side of the wire 5 is held by the tip portion of the holding shaft 129 and the side surface (guide recess 20) of the wire guide passage (curl guide 12).

The start end portion 5*a* of the wire 5 cannot be freely moved because it is hooked and pressed at a part including the termination portion 5*b* of the wire 5 held at the guide part 6. Even when the wire is twisted by the wire twisting device at the state where both ends 5*a*, 5*b* are held in this way, both end portions 5*a*, 5*b* of the wire 5 can be enabled to stay on the back sides of the reinforcing bars. Since the driving part is used separately from the wire cutting mechanism, it is possible to arbitrarily adjust the wire holding timing, independently. In the ninth to twelfth illustrative embodiments, the termination portion 5*b* of the wire 5 is held using the curl guide 12, the pressing member and the holding member. Since the wire guide passage of the curl guide 12 is wide, it is possible to easily adjust the arrangements of the pressing member and the holding member.

After binding the reinforcing bars, the holding shaft 129 is returned to the original position through another link mechanism by the driving part of the reinforcing bar binding machine. Therefore, the holding state of the one side 5*c* of the termination portion 5*b*-side of the wire 5 is released, so that it is possible to smoothly and simply pull out both ends 5*a*, 5*b* of the cut and twisted wire 5 from the binding machine main body 2 without any deformation.

Figure 16A:
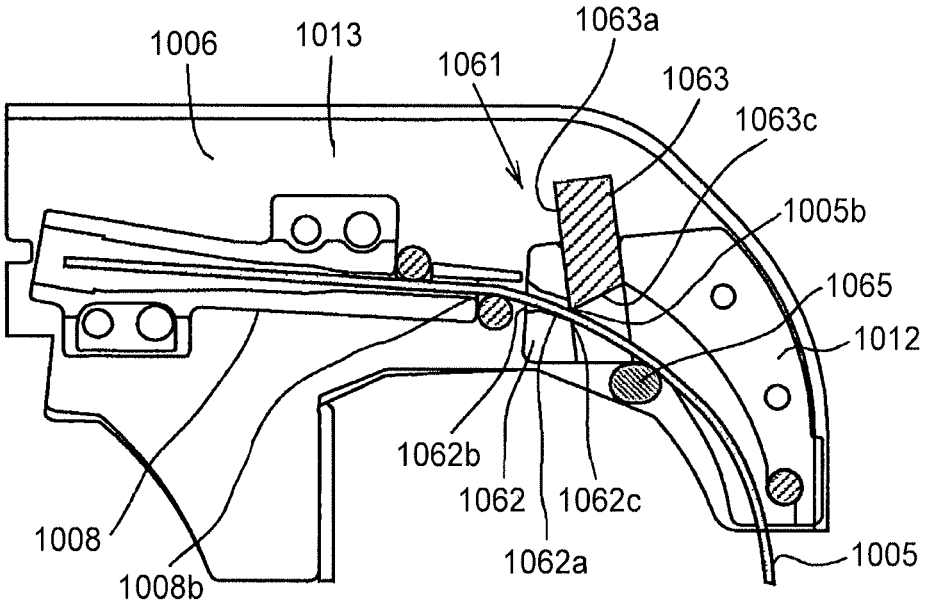
FIGS. 16A and 16B are side views illustrating a thirteenth illustrative embodiment of the guide part of the reinforcing bar binding machine.

A thirteenth illustrative embodiment of the guide part 1006 is described. As shown in FIG. 16A, when a feeding length of the wire 1005 reaches a predetermined amount, a wire cutting mechanism 1061 cuts the wire 1005. That is, the wire cutting mechanism 1061 is a slide cutter having a fixed blade 1062 fixed to the guide frame 1013, a moveable blade 1063 configured to slide to the fixed blade 1062 and to cut the wire 1005, and the driving lever 1016 configured to move the moveable blade 1063.

The fixed blade 1062 is formed with a wire penetration hole 1062*a* penetrated in the feeding direction of the wire 1005. One end of the wire penetration hole 1062*a* opens towards the tip portion 1008*b* of the guide component 1008, and the other end opens towards the curl guide 1012. The one end-side opening of the wire penetration hole 1062*a* is a wire entry opening 1062*b*, and the other end-side opening of the wire penetration hole 1062*a* is a wire exit opening 1062*c*.

Figure 16B:
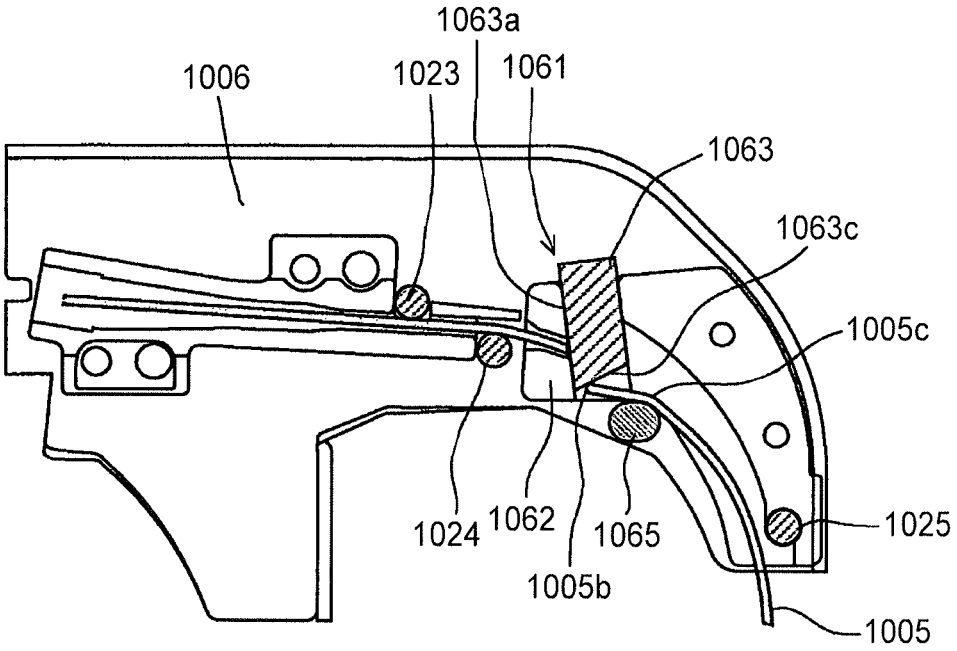

As shown in FIG. 16B, the wire cutting mechanism 1061 is configured to move downwards (from an outer side towards an inner side of a curve of the wire) the moveable blade 1063 by the driving lever 1016, to enable one surface 1063*a* of the moveable blade 1063 to slide downwards along a surface of the wire exit opening 1062*c*-side of the wire penetration hole 1062*a* of the fixed blade 1062, and to enable a lower end edge of the one surface (cutting surface) 1063*a* of the moveable blade 1063 to cut the wire 1005 having passed through the wire penetration hole 1062*a*.

The guide frame 1013 is provided with a support pin (support member) 1065 configured to support the wire 1005 fed out from the wire penetration hole 1062*a* of the fixed blade 1062 at a downstream (opposite) position of the one surface (cutting surface) 1063*a* of the moveable blade 1063 with respect to the feeding direction of the wire 1005. The fixed blade 1062 is configured to support one side of the wire cutting portion 1005*b* upon the wire cutting of the moveable blade 1063. The support pin 1065 is configured to support the other side of the wire cutting portion 1005*b* upon the wire cutting of the moveable blade 1063. That is, upon the wire cutting of the moveable blade 1063, both sides of the wire cutting portion 1005*b* are supported by the moveable blade 1063 and the support pin 1065.

The moveable blade 1063 is configured to push the cut portion (hereinafter, referred to as 'termination portion') 1005*b* of the cut and separated wire 1005 in a cutting direction (downward direction) by a lower end portion 1063*c*. The support pin 1065 also has a function as a contact part configured to contact and bend the one side 1005*c* of the termination portion 1005*b*-side of the wire 1005 pushed by the moveable blade 1063. The one side 1005*c* of the termination portion 1005*b*-side of the wire 1005 pushed by the lower end portion 1063*c* of the moveable blade 1063 is bent by the support pin 1065. Therefore, the reinforcing bar binding machine 1001 is configured to sandwich and hold the one side 1005*c* of the termination portion 1005*b*-side of the cut wire 1005 by the lower end portion 1063*c* of the moveable blade 1063 and the support pin 1065. The one side 1005*c* of the termination portion 1005*b*-side of the wire 1005 indicates a position to which the support pin 1065 is contacted.

According to the reinforcing bar binding machine 1001 having the above configuration, after the wire 1005 is curled at the guide part 1006 and is then wound around the reinforcing bars 1007, the wire cutting mechanism 1061 operates to move the moveable blade 1063 downwards to cut the wire. Upon the wire cutting of the moveable blade 1063, since both sides of the wire cutting portion 1005*b* are supported by the fixed blade 1062 and the support pin 1065, the free end-side of the wire 1005 is not bent in the cutting direction of the moveable blade 1063 upon the cutting and the cutting operation can be securely and smoothly performed. As shown in FIG. 16B, after the cutting, the lower end portion 1063*c* of the moveable blade 1063 pushes the termination portion 1005*b* of the cut wire 1005 in the cutting direction (downward direction), so that the one side 1005*c* of the termination portion 1005*b*-side of the wire 1005 is bent by the support pin 1065.

The moveable blade 1063 is stopped at the cutting position after the cutting. The one side 1005*c* of the termination portion 1005*b*-side of the wire 1005 is sandwiched by the lower end portion 1063*c* of the moveable blade 1063 and the support pin 1065. Thereby, the one side 1005*c* of the termination portion 1005*b*-side of the wire 1005 is held by the lower end portion 1063*c* of the moveable blade 1063 and the support pin 1065. The start end portion 1005*a* of the wire 1005 cannot be freely moved because it is hooked and pressed at a part including the termination portion 1005*b* of the wire 1005 held at the guide part 1006. Even when the wire is twisted by the wire twisting device at the state where both ends 1005*a*, 1005*b* are held in this way, both end portions 1005*a*, 1005*b* of the wire 1005 can be enabled to stay on the back sides of the reinforcing bars. It is possible to bend the wire 1005 and to hold the termination portion 1005*b* of the wire by using the operation of cutting the wire 1005 by the moveable blade 1063 and the support pin 1065.

After binding the reinforcing bars, the moveable blade 1063 is returned to the original position before the cutting. Therefore, the holding state of the one side 1005*c* of the termination portion 1005*b*-side of the wire 1005 is released, so that it is possible to smoothly and simply pull out both ends 1005*a*, 1005*b* of the cut and twisted wire 1005 from the binding machine main body 1002 without any deformation.

Figure 17A:
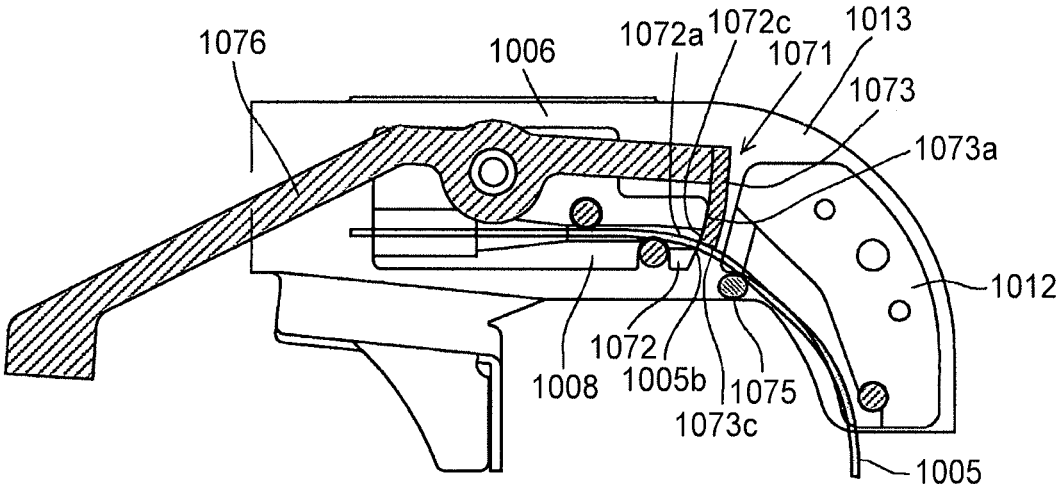
FIGS. 17A and 17B are side views illustrating a fourteenth illustrative embodiment of the guide part of the reinforcing bar binding machine.

In the thirteenth illustrative embodiment, the vertical sliding-type wire cutting mechanism 1061 has been described. However, as shown in FIG. 17A, it is possible to accomplish the same operational effects by a swinging-type wire cutting mechanism 1071, too. When a feeding length of the wire 1005 reaches a predetermined amount, the wire cutting mechanism 1071 cuts the wire 1005. That is, the wire cutting mechanism 1071 is a slide cutter having a fixed blade 1072 fixed to the guide frame 1013, a moveable blade 1073 configured to slide to the fixed blade 1072 and to cut the wire 1005, and a swinging lever 1076 configured to move the moveable blade 1073.

The fixed blade 1072 is integrally formed with the tip portion of the guide component 1008 and is formed with a wire penetration hole 1072*a* penetrated in the feeding direction of the wire 1005. One end of the wire penetration hole 1072*a* continues to a tip portion opening of the guide component 1008, and the other end opens towards the curl guide 1012. The other end-side opening of the wire penetration hole 1072*a* is a wire exit opening 1072*c*.

Figure 17B:
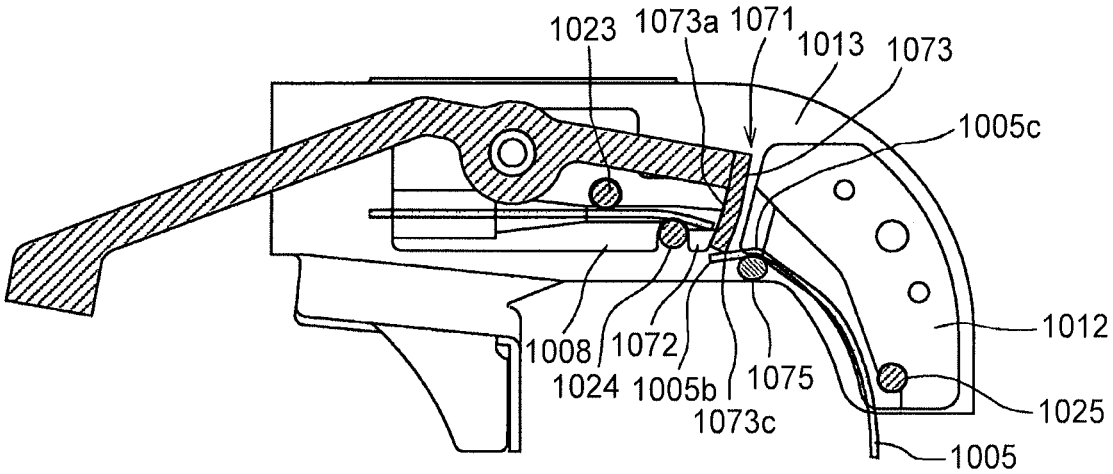

As shown in FIG. 17B, the wire cutting mechanism 1071 is configured to move downwards (from an outer side towards an inner side of a curve of the wire) the moveable blade 1073 by the swinging lever 1076, to enable one surface 1073*a* (cutting surface) of the moveable blade 1073 to slide downwards along a surface of the wire exit opening 1072*c*-side of the wire penetration hole 1072*a* of the fixed blade 1072, and to enable a lower end edge of the one surface 1073*a* (cutting surface) of the moveable blade 1073 to cut the wire 1005 having passed through the wire penetration hole 1072*a*.

The guide frame 1013 is provided with a support pin (support member) 1075 configured to support the wire 1005 fed out from the wire penetration hole 1072*a* of the fixed blade 1072 at a downstream (opposite) position of the one surface (cutting surface) 1073*a* of the moveable blade 1073 with respect to the feeding direction of the wire 1005. The fixed blade 1072 is configured to support one side of the wire cutting portion 1005*b* upon the wire cutting of the moveable blade 1073. The support pin (support member) 1075 is configured to support the other side of the wire cutting portion 1005*b* upon the wire cutting of the moveable blade 1073. That is, upon the wire cutting of the moveable blade 1073, both sides of the wire cutting portion 1005*b* are supported by the fixed blade 1072 and the support pin 1075.

The moveable blade 1063 is configured to push the cut end portion (hereinafter, referred to as 'termination portion') 1005*b* of the cut and separated wire 1005 in a cutting direction (downward direction) by a lower end portion 1073*c*. The support pin 1075 also has a function as a contact part configured to contact and bend the one side 1005*c* of the termination portion 1005*b*-side of the wire 1005 pushed by the moveable blade 1073. The one side 1005*c* of the termination portion 1005*b*-side of the wire 1005 pushed by the lower end portion 1073*c* of the moveable blade 1073 is bent by the support pin 1075. Therefore, the reinforcing bar binding machine 1001 is configured to sandwich and hold the one side 1005*c* of the termination portion 1005*b*-side of the cut wire 1005 by the lower end portion 1073*c* of the moveable blade 1073 and the support pin 1075. The one side 1005*c* of the termination portion 1005*b*-side of the wire 1005 indicates a position to which the support pin 1075 is contacted.

According to the reinforcing bar binding machine 1001 having the above configuration, after the wire 1005 is curled at the guide part 1006 and is then wound around the reinforcing bars 1007, the wire cutting mechanism 1071 operates to move the moveable blade 1073 downwards to cut the wire. Upon the wire cutting of the moveable blade 1073, since both sides of the wire cutting portion 1005*b* are supported by the fixed blade 1072 and the support pin 1075, the free end-side of the wire 1005 is not bent in the cutting direction of the moveable blade 1063 upon the cutting and the cutting operation can be securely and smoothly performed. After the cutting, the lower end portion 1073*c* of the moveable blade 1073 pushes the termination portion 1005*b* of the cut wire 1005 in the cutting direction (downward direction), so that the one side 1005*c* of the termination portion 1005*b*-side of the wire 1005 is bent by the support pin 1075.

The moveable blade 1073 is stopped at the cutting position after the cutting. The one side 1005*c* of the termination portion 1005*b*-side of the wire 1005 is sandwiched by the lower end portion 1073*c* of the moveable blade 1073 and the support pin 1075. Thereby, the one side 1005*c* of the termination portion 1005*b*-side of the wire 1005 is held by the lower end portion 1073*c* of the moveable blade 1073 and the support pin 1075. The start end portion 1005*a* of the wire 1005 cannot be freely moved because it is hooked and pressed at a part including the termination portion 1005*b* of the wire 1005 held at the guide part 1006. Even when the wire is twisted by the wire twisting device at the state where both ends 1005*a*, 1005*b* are held in this way, both end portions 1005*a*, 1005*b* of the wire 1005 can be enabled to stay on the back sides of the reinforcing bars. It is possible to bend the wire 1005 and to hold the termination portion 1005*b* of the wire by using the operation of cutting the wire 1005 by the moveable blade 1073 and the support pin 1075.

After binding the reinforcing bars, the moveable blade 1073 is returned to the original position before the cutting. Therefore, the holding state of the one side 1005*c* of the termination portion 1005*b*-side of the wire 1005 is released, so that it is possible to smoothly and simply pull out both ends 1005*a*, 1005*b* of the cut and twisted wire 1005 from the binding machine main body 1002 without any deformation.

Figure 18A:
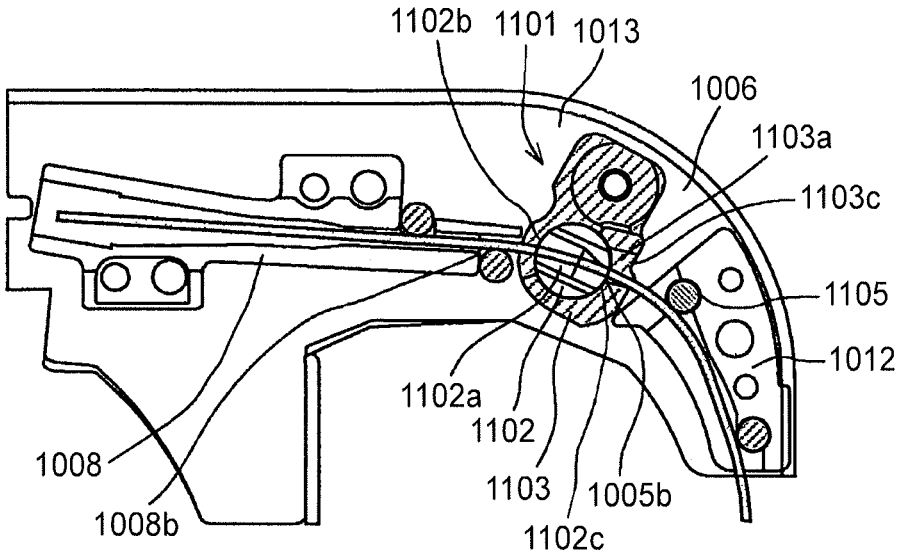
FIGS. 18A and 18B are side views illustrating a fifteenth illustrative embodiment of the guide part of the reinforcing bar binding machine.

In the thirteenth and fourteenth illustrative embodiments, the vertical sliding-type wire cutting mechanisms 1061, 1071 have been described. However, as shown in FIG. 18A, as a fifteenth illustrative embodiment, it is possible to accomplish the same operational effects by a rotation-type wire cutting mechanism 1101, too. When a feeding length of the wire 1005 reaches a predetermined amount, a wire cutting mechanism 1101 cuts the wire 1005. That is, the wire cutting mechanism 1101 is a rotary cutter having a circular shaft-shaped fixed blade 1102 fixed to the guide frame 1013, a moveable blade 1103 provided to be rotatable around the fixed blade 1102, and the driving lever 1016 configured to rotate the moveable blade 1103.

The circular shaft-shaped fixed blade 1102 is formed with a wire penetration hole 1102*a* penetrated in the feeding direction of the wire 1005. One end of the wire penetration hole 1102*a* opens towards the tip portion 1008*b* of the guide component 1008, and the other end opens towards the curl guide 1012. The one end-side opening of the wire penetration hole 1102*a* is a wire entry opening 1102*b*, and the other end-side opening of the wire penetration hole 1102*a* is a wire exit opening 1102*c*. Also, the moveable blade 1103 is formed with a wire insertion penetration hole 1103*a* penetrated in the feeding direction of the wire 1005. One end of the wire insertion penetration hole 1103*a* opens towards the wire exit opening 1102*c* of the wire penetration hole 1102*a* of the fixed blade 1102, and the other end opens towards the curl guide 1012. The one end-side opening of the wire insertion penetration hole 1103*a* of the moveable blade 1103 is a wire entry opening 1103*b*, and the other end-side opening of the wire insertion penetration hole 1103*a* is a wire discharge opening 1103*c*.

Figure 18B:
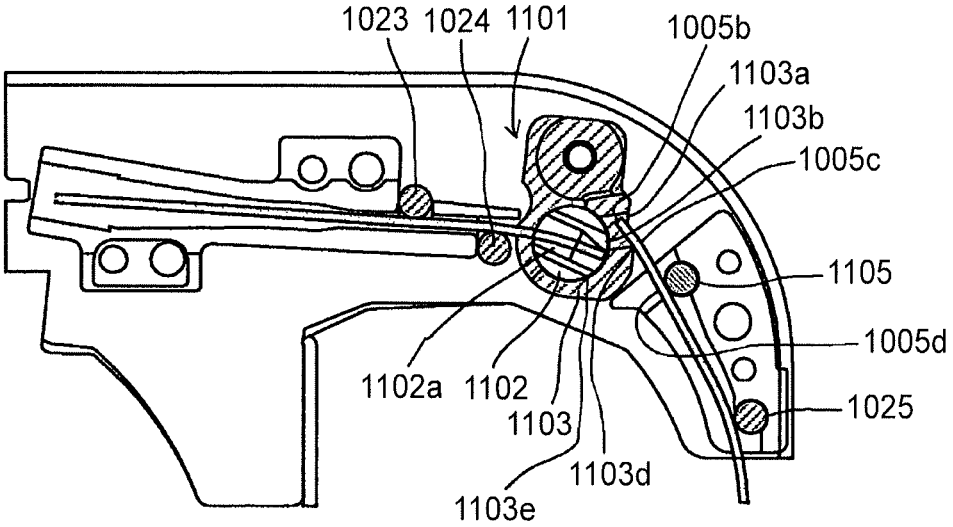

As shown in FIG. 18B, the wire cutting mechanism 1101 is configured to rotate the moveable blade 1103 in the counterclockwise direction by the driving lever 1016, to enable a surface 1103*e* (cutting surface) of the wire entry opening 1103*b*-side of the moveable blade 1103 to slide upwards along a surface of the wire exit opening 1102*c*-side of the fixed blade 1102, and to enable a lower end edge of the wire entry opening 1103*b* of the moveable blade 1103 to cut the wire 1005 having passed through the wire penetration hole 1102*a*.

The guide frame 1013 is provided with a support pin (support member) 1105 configured to support the wire 1005 fed out from the wire penetration hole 1102*a* of the fixed blade 1102 at a downstream (opposite) position of the cutting surface 1103*e* of the moveable blade 1103 with respect to the feeding direction of the wire 1005. The fixed blade 1102 is configured to support one side of the wire cutting portion 1005*b* upon the wire cutting of the moveable blade 1103. The support pin (support member) 1105 is configured to support the other side of the wire cutting portion 1005*b* upon the wire cutting of the moveable blade 1103. That is, upon the wire cutting of the moveable blade 1103, both sides of the wire cutting portion 1005*b* are supported by the moveable blade 1103 and the support pin 1105.

The moveable blade 1103 is configured to cut the wire 1005, and to push one side 1005*c* of the cut end portion (hereinafter, referred to as 'termination portion') 1005*b* of the cut and separated wire 1005 in a cutting direction (upward direction) by a lower end edge 1103*d* of the wire discharge opening 1103*c* of the wire insertion penetration hole 1103*a*. The support pin 1105 also has a function as a contact part configured to contact and bend the one side 1005*d* of the termination portion 1005*b*-side of the wire 1005 pushed by the moveable blade 1103. The one side 1005*d* of the termination portion 1005*b*-side of the wire 1005 pushed by the lower end edge 1103*d* of the moveable blade 1103 is bent by the support pin 1105. Therefore, the reinforcing bar binding machine 1001 is configured to sandwich and hold the one side 1005*d* of the termination portion 1005*b*-side of the cut wire 1005 by the lower end edge 1103*d* of the wire insertion penetration hole 1103*a* of the moveable blade 1103 and the support pin 1105. The one side 1005*d* of the termination portion 1005*b*-side of the wire 1005 indicates a position to which the support pin 1105 is contacted.

According to the reinforcing bar binding machine 1001 having the above configuration, after the wire 1005 is curled at the guide part 1006 and is then wound around the reinforcing bars 1007, the wire cutting mechanism 1101 operates to rotate the moveable blade 1103 upwards, so that the wire is cut by the lower end edge of the wire entry opening 1103*b* of the moveable blade 1103. Upon the wire cutting of the moveable blade 1103, since both sides of the wire cutting portion 1005*b* are supported by the fixed blade 1102 and the support pin 1105, the free end-side of the wire 1005 is not bent in the cutting direction of the moveable blade 1103 upon the cutting and the cutting operation can be securely and smoothly performed. As shown in FIG. 18B, after the cutting, the lower end edge 1103*d* of the wire discharge opening 1103*c* of the moveable blade 1103 pushes up the one side 1005*c* of the termination portion 1005*b*-side of the cut wire 1005 in the cutting direction (upward direction), so that the one side 1005*d* of the termination portion 1005*b* of the wire 1005 is sandwiched by the lower end edge 1103*d* of the wire discharge opening 1103*c* and the support pin 1105. The moveable blade 1103 is stopped at the cutting position after the cutting. Thereby, the one side 1005*d* of the termination portion 1005*b*-side of the wire 1005 is held by the moveable blade 1103 and the support pin 1105.

The start end portion 1005*a* of the wire 1005 cannot be freely moved because it is hooked and pressed at a part including the termination portion 1005*b* of the wire 1005 held at the guide part 1006. Even when the wire is twisted by the wire twisting device at the state where both ends 1005*a*, 1005*b* are held in this way, both end portions 1005*a*, 1005*b* of the wire 1005 can be enabled to stay on the back sides of the reinforcing bars. Since the termination portion 1005*b* of the wire 1005 is fitted with the moveable blade 1103 and the support pin 1105 by using the operation of the moveable blade 1103 upon the cutting of the wire 1005, it can be securely held.

After binding the reinforcing bars, the moveable blade 1103 is returned to the original position before the cutting. Therefore, the holding state of the one side 1005*d* of the termination portion 1005*b*-side of the wire 1005 is released, so that it is possible to smoothly and simply pull out both ends 1005*a*, 1005*b* of the cut and twisted wire 1005 from the binding machine main body 1002 without any deformation.

The guide part 1006 of the reinforcing bar binding machine 1001 is provided with the curling mechanism configured to curl and feed out the wire 1005. The wire 1005 guided and led out by the guide component 1008 is curled by the curling mechanism, is fed out by a predetermined length, is wound around the reinforcing bars 1007 and is then cut by the wire cutting mechanism.

Figure 19A:
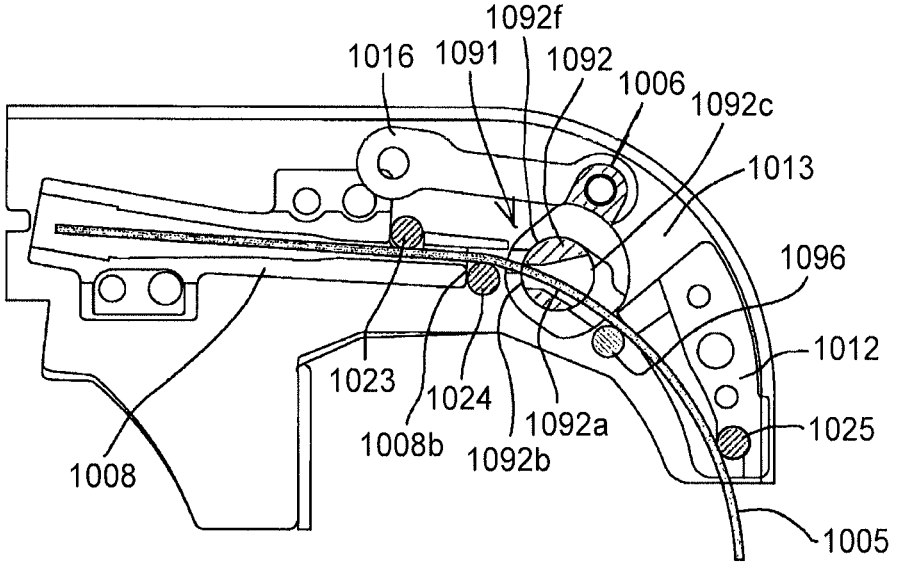
FIGS. 19A and 19B are side views illustrating a sixteenth illustrative embodiment of the guide part of the reinforcing bar binding machine.

In the fifteenth illustrative embodiment, the fixed blade and the moveable blade of the wire cutting mechanism of the rotary cutter may be reversed. That is, as shown in FIG. 19A, it is possible to accomplish the same operational effects with a configuration where a circular shaft-shaped fixed blade is fixed to the guide frame 1013, a moveable blade is provided to be rotatable and accommodated inside the fixed blade and the driving lever 1016 is configured to rotate the moveable blade. In the below, this configuration is described as a sixteenth illustrative embodiment.

As shown in FIG. 19, when a feeding length of the wire 1005 reaches a predetermined amount, a wire cutting mechanism 1091 cuts the wire 1005. That is, the wire cutting mechanism 1091 is a rotary cutter having a circular shaft-shaped moveable blade 1092 provided to be rotatable, a fixed blade 1093 fixed to the guide frame 1013 and configured to rotatably accommodate the circular shaft-shaped moveable blade 1092 and the driving lever 16 configured to rotate the moveable blade 1092.

The circular shaft-shaped moveable blade 1092 is formed with a wire penetration hole 1092*a* penetrated in the feeding direction of the wire 1005. One end of the wire penetration hole 1092*a* opens towards the tip portion 1008*b* of the guide component 1008, and the other end opens towards the curl guide 1012. The one end-side opening of the wire penetration hole 1092*a* is a wire entry opening 1092*b*, and the other end-side opening of the wire penetration hole 1092*a* is a wire exit opening 1092*c*. Also, the fixed blade 1093 is formed with a wire insertion penetration hole 1093*a* penetrated in the feeding direction of the wire 1005. One end of the wire insertion penetration hole 1093*a* opens towards the guide component 1008, and the other end of the wire insertion penetration hole 1093*a* opens towards the wire entry opening 1092*b* of the wire penetration hole 1092*a* of the moveable blade 1092. The one end-side opening of the wire insertion penetration hole 1093*a* is a wire entry opening 1093*b*, and the other end-side opening of the wire insertion penetration hole 1093*a* is a wire discharge opening 1093*c*.

Figure 19B:
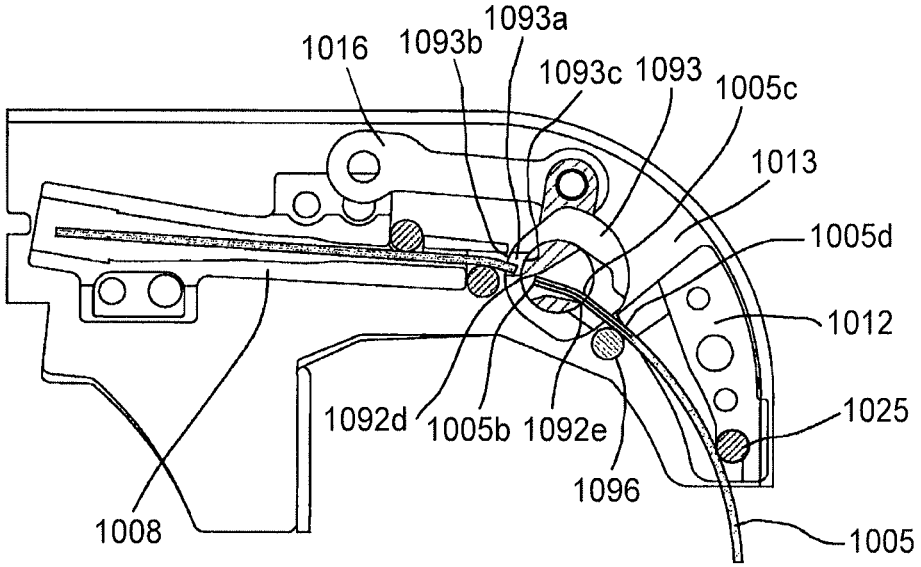

As shown in FIG. 19B, the wire cutting mechanism 1091 is configured to rotate the moveable blade 1092 in the counterclockwise direction by the driving lever 1016, to enable a surface (cutting surface) 1092*f* of the wire entry opening 1092*b*-side of the moveable blade 1092 to slide downwards along a surface of the wire discharge opening 1093*c*-side of the fixed blade 1093, and to enable an upper end edge 1092*d* of the wire entry opening 1092*b* of the moveable blade 1092 to cut the wire 1005 having passed through the wire penetration hole 1092*a*.

The guide frame 1013 is provided with a support pin (support member) 1096 configured to support the wire 1005 fed out from the wire penetration hole 1092*a* of the moveable blade 1092 at a downstream (opposite) position of the cutting surface 1092*f* of the moveable blade 1092 with respect to the feeding direction of the wire 1005. The fixed blade 1093 is configured to support one side of the wire cutting portion 1005*b* upon the wire cutting of the moveable blade 1092. The support pin (support member) 1096 is configured to support the other side of the wire cutting portion 1005*b* upon the wire cutting of the moveable blade 1092. That is, upon the wire cutting of the moveable blade 1092, both sides of the wire cutting portion 1005*b* are supported by the fixed blade 1093 and the support pin 1096.

The moveable blade 1092 is configured to cut the wire 1005, and to push and bend one side 1005*c* of the cut end portion (hereinafter, referred to as 'termination portion') 1005*b* of the cut and separated wire 1005 in a counter-cutting direction (upward direction) by a lower end edge 1092*e* of the wire exit opening 1092*c* of the wire penetration hole 1092*a* and to form a bent part. Therefore, the reinforcing bar binding machine 1001 is configured to hold the one side 1005*c* (bent part) of the termination portion 1005*b*-side of the cut wire 1005 by the lower end edge 1092*e* of the wire penetration hole 1092*a* of the moveable blade 1092 and to hold the termination portion 1005*b* of the wire 1005 by the upper end edge 1092*d*-side of the moveable blade 1092. Also, a vicinity 1005*d* of the termination portion of the wire 1005 is held by the support pin 1096. The one side 1005*c* of the termination portion 1005*b*-side of the wire 1005 indicates a position to which the lower end edge 1092*e* of the wire penetration hole 1092*a* of the moveable blade 1092 is contacted.

According to the reinforcing bar binding machine 1001 having the above configuration, after the wire 1005 is curled at the guide part 1006 and is then wound around the reinforcing bars 1007, the wire cutting mechanism 1091 operates to rotate the moveable blade 1092, so that the wire is cut by the upper end edge 1092*d* of the wire entry opening 1092*b* of the wire penetration hole 1092*a* of the moveable blade 1092. Upon the wire cutting of the moveable blade 1092, since both sides of the wire cutting portion 1005*b* are supported by the fixed blade 1093 and the support pin 1096, the free end-side of the wire 1005 is not bent in the cutting direction of the moveable blade 1093 upon the cutting and the cutting operation can be securely and smoothly performed. Simultaneously with the cutting, the lower end edge 1092*e* of the wire exit opening 1092*c* of the wire penetration hole 1092*a* of the moveable blade 1092 pushes up the one side 1005*c* of the termination portion 1005*b*-side of the cut wire 1005 in the cutting direction (upward direction), the lower end edge 1092*e* of the wire penetration hole 1092*a* of the moveable blade 1092 holds the one side 1005*c*, and the upper end edge 1092*d* of the moveable blade 1092 holds the termination portion 1005*b* of the wire 1005. Also, the vicinity 1005*d* of the termination portion of the wire 1005 is held by the support pin 1096. The moveable blade 1092 is stopped at the cutting position after the cutting. Thereby, the one side 1005*c* of the termination portion 1005*b*-side of the wire 1005 is held at the lower end edge 1092*e* of the wire exit opening 1092*c* of the moveable blade 1092, the termination portion 1005*b* of the wire 1005 is held at the upper end edge 1092*d* of the wire entry opening 1092*b* of the moveable blade 1092 and the vicinity 1005*d* of the termination portion of the wire 1005 is held at the support pin 1096.

The start end portion 1005*a* of the wire 1005 cannot be freely moved because it is hooked and pressed at a part including the termination portion 1005*b* of the wire 1005 held at the guide part 1006. Even when the wire is twisted by the wire twisting device at the state where both ends 1005*a*, 1005*b* are held in this way, both end portions 1005*a*, 1005*b* of the wire 1005 can be enabled to stay on the back sides of the reinforcing bars. It is possible to securely hold the termination portion 1005*b* of the wire 1005 with the moveable blade 1092 and the support pin 1096 by using the operation of the moveable blade 1092 upon the cutting of the wire 1005.

After binding the reinforcing bars, the moveable blade 1092 is returned to the original position before the cutting. Therefore, the holding state of the termination portion 1005*b*-side of the wire 1005 is released, so that it is possible to smoothly and simply pull out both ends 1005*a*, 1005*b* of the cut and twisted wire 1005 from the binding machine main body 1002 without any deformation.

The curling mechanism includes the first guide member 1023 serving as a first curling guide member configured to guide an outer surface of the wire 1005 becoming a bent outer side thereof, the second guide member 1024 serving as a second curling guide member configured to guide an inner surface of the wire 1005 becoming a bent inner side thereof, the fourth guide member 1065 (1075, 1096, 1105) serving as a fourth curling guide member configured to guide a bent side surface of the wire, and the third guide member 1025 serving as a third curling guide member configured to guide an outer surface of the wire becoming a bent outer side thereof, which are sequentially arranged on the wire feeding path from the wire exit opening 1008*b* of the end portion of the guide component 1008 or a vicinity thereof. The fourth guide member 1065; 1075; 1096 is configured to guide an inner surface of the wire becoming a bent inner side, as shown in FIGS. 16, 17, and 19. The fourth guide member 1105 is configured to guide an outer surface of the wire becoming a bent outer side, as shown in FIG. 18. The reinforcing bar binding machine 1001 is configured to bring the wire 1005 into sequential contact with the curling mechanism arranged on the wire feeding path, i.e., the first guide member 1023, the second guide member 1024, the fourth guide member 1065 (1075, 1096, 1105) and the third guide member 1025 upon the feeding of the wire, thereby curling the wire 1005.

The guide members 1023 to 1025 and 1065 (1075, 1097, 1105) are configured by the cylindrical guide members of which a sectional shape is circular, respectively. The guide, member is preferably made of a high hardness material such as carbide pins (cemented carbide pins or ceramic pins) because it is not worn well. Also, the first guide member and the second guide member may have a shape of a guide part integrally formed with the guide component 1008, not the pin shape. Also, the third guide member may have a shape of a guide part integrally formed with the curl guide 1012, not the pin shape. Also, the fourth guide member may have a shape of a guide part of a convex part provided for the guide frame 1013, not the pin shape.

Specifically, the first guide member 1023 is provided at an upper notched part of the tip 1008*b* of the guide component 1008. The second guide member 1023 is provided at a lower part-side of the tip 1008*b* of the guide component 1008. The third guide member 1025 is arranged inside the rear end of the curl guide 1012. The fourth guide member 1065 (1075, 1096, 1105) is arranged inside the tip portion of the curl guide 1012, as shown in FIGS. 16 to 18.

In this way, the wire 1005 fed out from the guide component 1008 is guided with the outer surface of the wire 1005 configuring a bent outer side thereof being contacted to the first guide member 1023 and with the inner surface of the wire 1005 configuring a bent inner side thereof being contacted to the second guide member 1024, passes through the wire penetration hole 1062*a* (1072*a*, 1092*a*, 1102*a*) of the fixed blade 1062 (1072, 1102) or the moveable blade 1092, is guided with the bent side surface of the wire 1005 fed out along the guide surface 1021 of the curl guide 1012 being contacted to the fourth guide member 1065 (1075, 1096, 1105) and with the bent outer surface of the wire 1005 being contacted to the third guide member 1025, is curled and is then fed downwards. The guide member, which is one member of the curling mechanism configured to curl the wire 1005, i.e., the fourth guide member 1065 (1075, 1096, 1105) can be enabled to function as the support pin (support member).

In the illustrative embodiments, both sides of the cut end portion 1005*b* of the wire 1005 are supported by the fixed blade 1062; 1072; 1093; 1102 and the support member 1067; 1075; 1096; 1105. That is, both-end support method has been described. That is, upon the wire cutting by the wire cutting mechanism 1061; 1071; 1091; 1101, in order to securely transmit the force for cutting of the wire 1005, which is applied to the wire 1005 in the cutting direction, the guide part 1006 of the reinforcing bar binding machine 1001 is provided with the support member 1065; 1075; 1096; 1105 so that the wire 1005 is not deformed at an opposite position in the wire cutting direction. In this way, when the guide part 1006 of the reinforcing bar binding machine 1001 is provided with the support member 1065; 1075; 1096; 1105 configured to support the wire 1005 fed out from the wire cutting mechanism 1061; 1071; 1091; 1101 at the downstream-side position of the cutting part of the wire cutting mechanism 1061; 1071; 1091; 1101 with respect to the feeding direction of the wire 1005, the support member 1065; 1075; 1096; 1105 supports the wire 1005 upon the wire cutting of the wire cutting mechanism 1061; 1071; 1091; 1101. Upon the wire cutting of the wire cutting mechanism 1061; 1071; 1091; 1101, since the reinforcing bar binding machine 1001 supports the wire 1005 with the support member 1065; 1075; 1096; 1105, the wire 1005 is not bent in the cutting direction upon the cutting and the cutting operation can be securely and smoothly performed.

Also, the fixed blade 1062; 1072 may be replaced with a fixed member having no blade or the fixed blade 1062; 1072 may be provided with a separate fixed member, and the wire 1005 may be supported by the both-end support method of the fixed member and the support member 1065; 1075. That is, the guide part 1006 of the reinforcing bar binding machine 1001 is provided with the fixed member 1062; 1072 configured to support the wire at an upstream position of the cutting part of the wire cutting mechanism 1061; 1071 with respect to the feeding direction of the wire 1005. The fixed member 1062; 1072 is configured to support one side of the wire cutting portion 1005*b* upon the wire cutting, and the support member 1065; 1075 is configured to support the other side of the wire cutting portion 105*b*. Upon the wire cutting of the wire cutting mechanism 1061; 1071, the reinforcing bar binding machine 1001 is configured to support both sides of the wire cutting portion 1005*b* with the fixed member 1062; 1072 and the support member 1065; 1075. Therefore, the wire 1005 is not bent in the cutting direction upon the cutting and the cutting operation can be securely and smoothly performed.

Also, the fixed blade 1062; 1072; 1093; 1102 may be configured as a moveable blade, so that the cutting operation may be performed by a pair of moveable blades. That is, the wire cutting mechanism 1061; 1071; 1091; 1101 is configured as a cutter having a first moveable blade 1062; 1072; 1093; 1102 and a second moveable blade 1063; 1073; 1092; 1103 configured to slide or swing to the first moveable blade 1062; 1072; 1093; 1102 and to cut the wire 1005. The first moveable blade 1062; 1072; 1093; 1102 or second moveable blade 1063; 1073; 1092; 1103 is configured to support one side of the wire cutting portion 1005*b* upon the wire cutting. The support member 1065; 1075; 1096; 1105 is configured to support the other side of the wire cutting portion 1005*b* upon the wire cutting. In this way, upon the wire cutting of the pair of moveable blades, the reinforcing bar binding machine is configured to support both sides of the wire cutting portion 1005*b* with one of the first moveable blade 1062; 1072; 1093; 1102 or second moveable blade 1063; 1073; 1092; 1103 and the support member 1065; 1075; 1096; 1105. Therefore, the wire 1005 is not bent in the cutting direction upon the cutting and the cutting operation can be securely and smoothly performed.

(A1) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a fixed blade having a wire penetration hole penetrated in a feeding direction of the wire and a moveable blade configured to slide or swing to the fixed blade and to cut the wire. The guide part is provided with a holding device configured to hold a cut end portion-side of the wire cut and separated in conjunction with a cutting operation of the moveable blade, and the holding device is a bending part configured to bend and hold the cut end portion-side of the cut and separated wire.

(A2) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a moveable blade having a wire penetration hole penetrated in a feeding direction of the wire and a fixed blade configured to rotatably accommodate the moveable blade. A wire entry opening-side of the wire penetration hole slides to the fixed blade and cuts the wire as the moveable blade is rotated. The guide part is provided with a holding device configured to hold a cut end portion-side of the wire cut and separated in conjunction with a cutting operation of the moveable blade, and the holding device is an end portion edge of a wire exit opening of the wire penetration hole of the moveable blade configured to bend and hold the cut end portion-side of the cut and separated wire.

(A3) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a fixed blade having a wire penetration hole penetrated in a feeding direction of the wire and a moveable blade configured to slide or swing to the fixed blade and to cut the wire. The guide part is provided with a holding device configured to hold a cut end portion-side of the wire cut and separated in conjunction with a cutting operation of the moveable blade, and the holding device is configured by a contact part configured to contact and bend the cut end portion-side of the cut and separated wire.

(A4) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a fixed blade having a wire penetration hole penetrated in a feeding direction of the wire and a moveable blade configured to slide or swing to the fixed blade and to cut the wire. A tip portion of the moveable blade is formed with a bending part configured to bend a cut end portion-side of the cut and separated wire. The guide part is provided with a holding device configured to hold the cut end portion-side of the wire cut and separated in conjunction with a cutting operation of the moveable blade, and the holding device is a contact part configured to be contacted and engaged with the cut end portion-side of the wire bent with the bending part formed at the tip portion of the moveable blade.

(A5) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a moveable blade having a wire penetration hole penetrated in a feeding direction of the wire and a fixed blade configured to rotatably accommodate the moveable blade. A wire entry opening-side of the wire penetration hole slides to the fixed blade and cuts the wire as the moveable blade is rotated. The guide part is provided with a holding device configured to hold a cut end portion-side of the wire cut and separated in conjunction with a cutting operation of the moveable blade, and the holding device is configured by a contact part configured to contact the cut end portion-side of the cut and separated wire.

(A6) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a fixed blade having a wire penetration hole penetrated in a feeding direction of the wire and a moveable blade provided to be rotatable around the fixed blade. The moveable blade is configured to slide to a wire exit opening-side of the wire penetration hole of the fixed blade and to cut the wire as the moveable blade is rotated. The guide part is provided with a holding device configured to hold a cut end portion-side of the wire cut and separated in conjunction with a cutting operation of the moveable blade, and the holding device is configured by the moveable blade and a contact part configured to contact the cut end portion-side of the cut and separated wire.

(A7) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a fixed blade having a wire penetration hole penetrated in a feeding direction of the wire and a moveable blade configured to slide or swing to the fixed blade and to cut the wire. The guide part is provided with a holding device configured to hold a cut end portion-side of the wire cut and separated in conjunction with a cutting operation of the moveable blade, and the holding device is a pressing part configured to press the cut end portion-side of the cut and separated wire to a side surface of a wire guide passage.

(A8) In the reinforcing bar bending machine of (A7), the holding device is configured so that the pressing part presses and holds the cut end portion-side of the cut and separated wire to the side surface of the wire guide passage.

(A9) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a fixed blade having a wire penetration hole penetrated in a feeding direction of the wire and a moveable blade provided to be rotatable around the fixed blade. The cutter is configured to cut the wire as the moveable blade is rotated. The guide part is provided with a holding device configured to hold a cut end portion-side of the wire cut and separated in conjunction with a cutting operation of the moveable blade, and the holding device is a holding member coupled by the moveable blade and a link mechanism and configured to press the cut end portion-side of the wire separated by the moveable blade to a side surface of a wire guide passage.

(A10) In the reinforcing bar bending machine of (A9), the holding device is configured so that the holding member presses and holds the cut end portion-side of the cut and separated wire to the side surface of the wire guide passage.

(A11) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism is a cutter having a moveable blade having a wire penetration hole penetrated in a feeding direction of the wire and a fixed blade configured to rotatably accommodate the moveable blade. The cutter is configured to cut the wire as the moveable blade is rotated. The guide part is provided with a holding device configured to hold a cut end portion-side of the wire cut and separated in conjunction with a cutting operation of the moveable blade, and the holding device is a holding member coupled by the moveable blade and a link mechanism and configured to press the cut end portion-side of the wire separated by the moveable blade to a side surface of a wire guide passage.

(A12) In the reinforcing bar bending machine of (A11), the holding device is configured so that the holding member presses and holds the cut end portion-side of the cut and separated wire to the side surface of the wire guide passage.

(A13) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The wire cutting mechanism includes a fixed blade and a moveable blade. The guide part is provided with a holding device configured to hold a cut end portion-side of the wire cut and separated in conjunction with a cutting operation of the moveable blade, and the holding device is a holding member coupled to a driving part of the binding machine main body by a link mechanism and configured to press the cut end portion-side of the wire separated by the moveable blade to a side surface of a wire guide passage.

(A14) In the reinforcing bar bending machine of (A13), the holding device is configured so that the holding member presses and holds the cut end portion-side of the cut and separated wire to the side surface of the wire guide passage.

(B1) There is provided a reinforcing bar bending machine configured to detachably mount a wire reel thereto, to feed a wire from the mounted wire reel, to feed the wire to a guide part provided at a tip portion of a binding machine main body, to curl the wire at the guide part, to feed out the wire around reinforcing bars positioned at an inner side of the guide part so that the wire is wound around the reinforcing bars, to cut the wire with a wire cutting mechanism, and to twist the wound wire to thus bind the reinforcing bars. The guide part is provided with a support member configured to support the wire fed out from the wire cutting mechanism-side at a downstream-side position of a cutting part of the wire cutting mechanism with respect to a feeding direction of the wire, and the support member is configured to support the wire upon wire cutting of the wire cutting mechanism.

(B2) In the reinforcing bar bending machine of (B1), the guide part is provided with a fixed member configured to support the wire at an upstream-side position of the cutting part of the wire cutting mechanism with respect to the feeding direction of the wire, the fixed member is configured to support one side of a wire cutting part upon the wire cutting, and the support member is configured to support the other side of the wire cutting portion upon the wire cutting.

(B3) In the reinforcing bar bending machine of (B1), the wire cutting mechanism is a cutter including a first moveable blade and a second moveable blade configured to slide or swing to the first moveable blade and to cut the wire, the first moveable blade or second moveable blade is configured to support one side of a wire cutting part upon the wire cutting, and the support member is configured to support the other side of the wire cutting portion upon the wire cutting.

(B4) In the reinforcing bar bending machine of (B1), the wire cutting mechanism is a cutter including the fixed blade and the moveable blade configured to slide or swing to the fixed blade and to cut the wire, the fixed blade is configured to support one side of a wire cutting part upon the wire cutting, and the support member is configured to support the other side of the wire cutting portion upon the wire cutting.

(B5) In the reinforcing bar bending machine of (B4), the fixed blade is formed with a wire penetration hole penetrated in a feeding direction of the wire, the wire is configured to be fed out from the wire penetration hole of the fixed blade, and the moveable blade is configured to operate at a wire exit opening-side of the wire penetration hole of the fixed blade and to cut the wire.

(B6) In the reinforcing bar bending machine of (B1), the wire cutting mechanism is a cutter including the fixed blade and the moveable blade provided to be rotatable around the fixed blade, the fixed blade is formed with a wire penetration hole penetrated in a feeding direction of the wire, the wire is configured to be fed out from the wire penetration hole of the fixed blade, the cutter is configured to cut the wire as the moveable blade is rotated, the fixed blade is configured to support one side of a wire cutting part upon the wire cutting, and the support member is configured to support the other side of the wire cutting portion upon the wire cutting.

(B7) In the reinforcing bar bending machine of (B1), the wire cutting mechanism is a cutter including the fixed blade and the rotatable moveable blade accommodated inside the fixed blade, the moveable blade is formed with a wire penetration hole penetrated in a feeding direction of the wire, the wire is configured to be fed out from the wire penetration hole of the moveable blade, the cutter is configured to cut the wire as the moveable blade is rotated, the fixed blade is configured to support one side of a wire cutting part upon the wire cutting, and the support member is configured to support the other side of the wire cutting portion upon the wire cutting.

(B8) In the reinforcing bar bending machine of any one of (B1) to (B7), the guide part is provided with a curling mechanism configured to curl the wire, the curling mechanism is provided with a plurality of guide members configured to guide an outer surface which is an outer side of the wire to be bent and an inner surface which is an inner side of the wire to be bent, and at least one of the guide members configures the support member.

What is claimed is:

1. A reinforcing bar binding machine, comprising:

a machine main body having a tip portion;

a guide part located at the tip portion;

wherein the guide part includes:

a wire cutting mechanism; and a contact part which contacts a wire cut by the wire cutting mechanism, wherein the wire cutting mechanism includes:

a fixed blade; and a movable blade which is movably mounted relative to the fixed blade to cut the wire, wherein the contact part is located at a downstream position from the movable blade with respect to a feeding direction of the wire, wherein the movable blade and the contact part hold a cut end portion of the wire cut and separated by the movable blade, and wherein:

the movable blade includes a wire penetration hole which extends in the feeding direction of the wire; and the fixed blade is configured to rotatably accommodate the movable blade, a wire entry opening-side of the wire penetration hole slides relative to the fixed blade by a rotation of the movable blade and cuts and separates the wire, and wherein the wire penetration hole includes a wire exit opening, the wire exit opening having an end portion edge, and wherein the end portion edge and the contact part hold the cut end portion of the cut and separated wire.

2. The reinforcing bar binding machine according to claim 1, wherein the contact part is configured to contact and to bend the cut end portion of the wire.

3. The reinforcing bar binding machine according to claim 1, further including a bending part located at a tip portion of the moveable blade, wherein the bending part is configured to bend the cut end portion of the wire.

4. The reinforcing bar binding machine according to claim 1, wherein:

the fixed blade has a wire penetration hole which extends in the feeding direction of the wire; and the moveable blade is rotatably mounted to be rotatable around the fixed blade.

5. The reinforcing bar binding machine according to claim 1, wherein the fixed blade includes a wire penetration hole which extends in the feeding direction of the wire, and the wire is fed through the wire penetration hole.

6. The reinforcing bar binding machine according to claim 1, further including a curl guide which includes a plurality of guide members;

wherein the guide members of the curl guide are positioned such that wire fed along the plurality of guide members is curled around an object being bound; and wherein the contact part includes one of the guide members of the curl guide.

7. The reinforcing bar binding machine according to claim 1, wherein the movable blade moves from a first position prior to cutting of the wire to a second position after cutting of the wire, and the wire is cut as the movable blade moves from the first position to the second position; and wherein the movable blade and the contact part hold the cut end portion of the wire when the movable blade is in the second position.

8. The reinforcing bar binding machine according to claim 7, wherein the contact part is positioned with respect to the movable blade such that the cut end portion of the wire is bent as the movable blade is moved from the first position to the second position.

9. The reinforcing bar binding machine according to claim 8, further including a curl guide which includes a plurality of guide members;

wherein the guide members of the curl guide are positioned such that wire fed along the plurality of guide members is curled around an object being bound; and wherein the contact part includes one of the guide members of the curl guide.

10. The reinforcing bar binding machine according to claim 9, further including a tapered guide upstream from the wire cutting mechanism, wherein the tapered guide has a narrower end positioned adjacent to the wire cutting mechanism; and wherein the tapered guide is positioned to feed the wire into the wire penetration hole, and feeds the wire into the wire penetration hole when the movable blade is in the first position.

11. The reinforcing bar binding machine according to claim 7, wherein at least one of the movable blade or the contact part is arranged to bend the cut end portion of the wire as the movable blade moves from the first position to the second position, including at least one of:

(i) the contact part is positioned with respect to the movable blade such that as the movable blade moves from the first position to the second position the cut end portion of the wire is bent at a location downstream of a cutting location at which the movable blade and the fixed blade cut the wire; or (ii) the movable blade includes a surface portion that protrudes or is inclined in a direction transverse to a wire feed direction when the movable blade is in the second position, such that said surface portion presses upon and bends the wire at the location downstream of the cutting location as the movable blade is moved from the first position to the second position.

* * * * *